US007584842B2

(12) United States Patent
Neumeyer et al.

(10) Patent No.: US 7,584,842 B2
(45) Date of Patent: Sep. 8, 2009

(54) TWO-PART VESSELS

(75) Inventors: Leo Neumeyer, Taren Point (AU); Kevin Wellington, Taren Point (AU); Mark Damian Neumeyer, Taren Point (AU)

(73) Assignee: Seaquist Closures Foreign, Inc., Crystal Lake, IL (US)

( * ) Notice: Subject to any disclaimer, the term of this patent is extended or adjusted under 35 U.S.C. 154(b) by 218 days.

(21) Appl. No.: 10/530,804

(22) PCT Filed: Oct. 10, 2003

(86) PCT No.: PCT/AU03/01339

§ 371 (c)(1), (2), (4) Date: Jan. 17, 2006

(87) PCT Pub. No.: WO2004/033336

PCT Pub. Date: Apr. 22, 2004

(65) Prior Publication Data

US 2007/0017830 A1 Jan. 25, 2007

(30) Foreign Application Priority Data

Oct. 10, 2002 (AU) ..... 2002951977

(51) Int. Cl.
*B65D 25/08* (2006.01)

(52) U.S. Cl. ..... 206/222; 215/DIG. 8

(58) Field of Classification Search ..... 206/222, 206/219, 220, 221; 215/DIG. 8
See application file for complete search history.

(56) References Cited

U.S. PATENT DOCUMENTS 5,246,142 A 9/1993 DiPalma et al.

(Continued)

FOREIGN PATENT DOCUMENTS

AU 590534 7/1986

(Continued)

OTHER PUBLICATIONS

English language version of first Office Action in the Chinese patent application No. 200380101242.X (corresponding to the instant, above-captioned U.S. Appl. No. 10/530,804), and which includes the "First Notification of Office Action" (3 pages) and "Text of the First Office Action" (2 pages), Aug. 4, 2006.

(Continued)

*Primary Examiner*—Jacob K Ackun, Jr.
(74) *Attorney, Agent, or Firm*—Wood, Phillips, Katz, Clark & Mortimer

(57) ABSTRACT

A device (10) for location at an opening to a receptacle comprises a projection in the form of a hingedly movable cutter (32) which is located on a sleeve (38) which is adapted for location at the opening of the receptacle. The device (10) also comprises a lid (12) for location at the opening including a sealed compartment (20) in the lid (12) that is positionable at the opening and a longitudinal rib (24) located inside the lid (12). In use when the lid (12) and its compartment (20) are positioned at the opening and the lid is rotated relative to the receptacle, the rib (24) is caused to act on the cutter (32) to move it into a position whereby it opens the sealed compartment (20). The movement of the lid (12) in a unidirectional rotation alone with respect to the receptacle causes both opening of the compartment (20) followed by removal of the lid (12) from the receptacle.

14 Claims, 17 Drawing Sheets

U.S. PATENT DOCUMENTS

| | | | | | |
|---|---|---|---|---|---|
| 5,772,017 | A * | 6/1998 | Kang | 206/222 |
| 5,927,549 | A * | 7/1999 | Wood | 222/83 |
| 6,135,275 | A * | 10/2000 | Kelders et al. | 206/221 |
| 6,138,821 | A | 10/2000 | Hsu | |
| 6,148,996 | A * | 11/2000 | Morini | 206/222 |
| 6,152,296 | A * | 11/2000 | Shih | 206/222 |
| 2002/0096440 | A1 * | 7/2002 | Kasuya | 206/222 |
| 2003/0017236 | A1 * | 1/2003 | Makita et al. | 426/115 |
| 2004/0118709 | A1 * | 6/2004 | Cho | 206/219 |
| 2005/0161348 | A1 * | 7/2005 | Morini | 206/219 |

FOREIGN PATENT DOCUMENTS

| | | | |
|---|---|---|---|
| AU | 602500 | | 6/1987 |
| AU | 602500 | | 11/1990 |
| AU | 653335 | | 10/1991 |
| AU | 643305 | | 1/1992 |
| AU | 653367 | | 5/1992 |
| AU | 661402 | | 1/1994 |
| AU | 683068 | | 12/1994 |
| AU | 672311 | | 2/1995 |
| AU | 681401 | | 2/1995 |
| AU | 679558 | | 5/1995 |
| AU | 680724 | | 10/1995 |
| AU | 686428 | | 4/1996 |
| AU | 712054 | | 5/1997 |
| AU | 711119 | | 6/1997 |
| AU | 731584 | | 1/1998 |
| AU | 731634 | | 7/1998 |
| AU | 728008 | | 9/1998 |
| AU | 747684 | | 5/1999 |
| AU | 737612 | | 10/1999 |
| AU | 752089 | | 12/1999 |
| AU | 756095 | | 12/1999 |
| AU | 732159 | | 2/2000 |
| AU | 752149 | | 5/2000 |
| AU | 756328 | | 5/2000 |
| AU | 199960667 | A1 | 5/2001 |
| AU | 737696 | | 8/2001 |
| AU | 200151881 | A1 | 2/2002 |
| DE | 199 50 884 | | 4/2001 |
| EP | 577200 | B1 | 7/1996 |
| JP | U-H01-161479 | | 11/1989 |
| JP | A-H07-080166 | | 3/1994 |
| JP | U-H07-011543 | | 2/1995 |
| WO | WO98/03265 | | 1/1998 |
| WO | WO 99/65783 | | 1/2000 |
| WO | WO 00/27717 | A1 | 5/2000 |
| WO | WO 00/27723 | A1 | 5/2000 |
| WO | WO 00/53507 | A1 | 9/2000 |
| WO | WO 00/78632 | A1 | 12/2000 |
| WO | WO 01/12520 | A1 | 2/2001 |
| WO | WO 01/36289 | A1 | 5/2001 |
| WO | WO 02/36065 | A1 | 5/2002 |
| WO | WO 02/36446 | A1 | 5/2002 |
| WO | WO 02/051711 | | 7/2002 |
| WO | WO2004/033336 | | 4/2004 |

OTHER PUBLICATIONS

English language version of "First Examination Report" (2 pages) in the Indian patent application No. 1417/DEL NP/02005 (corresponding to the instant, above-captioned U.S. Appl. No. 10/530,804), Nov. 28, 2006.

English language version of the "Communication pursuant to Article 94(3) EPC" EPA Form 2906 (1 page) and attached EPO Form 2001 (4 pages) in the European patent application No. 06735502.4 (corresponding to the instant, above-captioned U.S. Appl. No. 10/530,804), Dec. 28, 2007.

English language version of the Australian "Examiner's first report on patent application No. 2003266848" (2 pages) (corresponding to the instant, above-captioned U.S. Appl. No. 10/530,804), Dec. 12, 2006.

English language translation of Office Action for corresponding Japanese Patent Application No. 542102/2004, with a mailing date of Apr. 14, 2009.

* cited by examiner

FIG.12B
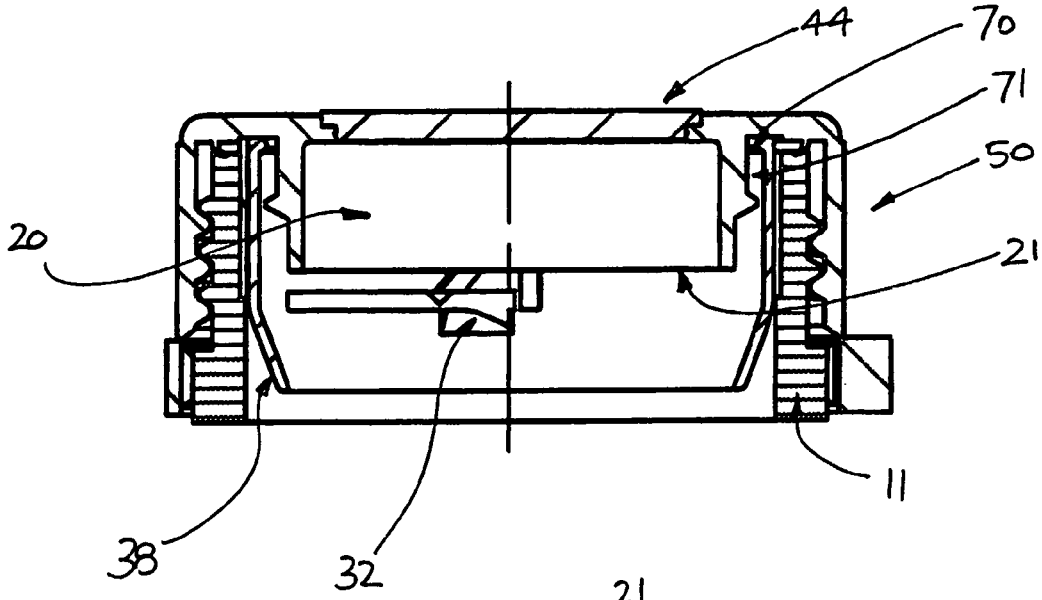
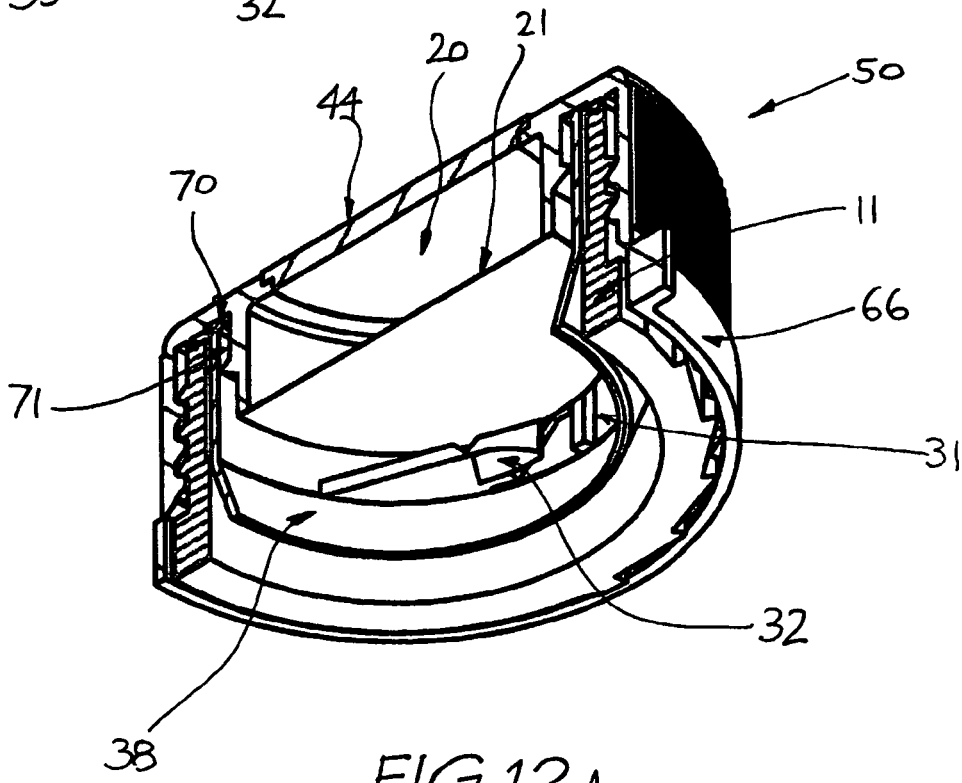
FIG.12A

TWO-PART VESSELS

This application is an application filed under 35 U.S.C. Sec. 371 as a national stage of international application PCT/AU2003/001339, which was filed Oct. 10, 2003.

FIELD OF THE INVENTION

The present invention relates to vessels having two compartments. Such vessels can be used in all manner of domestic, medical and industrial applications where the initiation of mixing of two substances needs to be controlled, and will primarily be described with reference to this context.

BACKGROUND ART

Many different types of containers are known in the prior art which enable the separation of two components of a mixture until use of the mixture is required. In containers where two or more products are supplied pre-mixed, the potency of the mixture may reduce rapidly with time. For example, mixtures such as medicines and antidotes have a limited shelf life after the active ingredients are mixed.

Some of the prior art containers have a membrane fitted into the interior of a lid of the container, the membrane made of tinfoil or thin plastic for example, which can be perforated by application of external pressure to an upper surface of the lid in order to actuate movement of a depressible tab or knife edge located in the lid. These containers are generally of complex construction which can make them costly to manufacture.

Generally in order to safely access the contents of the known prior art vessels, a multiple-step opening procedure must be followed. In each of U.S. Pat. No. 6,138,821 (Hsu) and DE19950884 (Wella AG), a prior art container is shown in which the lid of the container has a compartment which is opened by moving the lid so that a fixed projection opens the compartment therein. In the case of U.S. Pat. No. 6,138,821 (Hsu), once the compartment in the lid has been opened, and the lid is removed, the sharp projection fitted to the bottle throat needs to be removed by hand so that the contents can then be consumed without any risk of injury to the lips of a user. This introduces the possibility of injury to the fingers of a user, or contamination of the contents of the vessel by touching the throat region with dirty fingers. In DE19950884 (Wella AG), the actuation of the compartment opening mechanism by rotation of the cap downward in one direction causes the sharp projection to fall into the bottle itself and presents an even greater hazard to users if oral consumption by humans from such a bottle occurs. To access the bottle mouth for rapid pouring out of the contents, the cap then needs to be rotated in a reverse direction. Such a device is unsuitable for dispensing a tablet from the cap, and small fragments of foil may dislodge and fall into the bottle.

SUMMARY OF THE INVENTION

In a first aspect the present invention provides a device for location at an opening to a receptacle comprising:

- a projection adapted for association with the receptacle at the opening;
- a lid for location at the opening including a compartment that is positionable at the opening when the lid is located thereat; and
- engagement means associated with the lid;
- wherein when the compartment is positioned at or near the opening and the lid is moved in a given direction relative to the receptacle, the engagement means is caused to act on the projection such that the projection itself is moved into a position whereby it opens the compartment.

By associating the projection with the receptacle, and by causing the projection itself to be moved, the lid including the compartment can be of simpler construction than those known in the art for this purpose, and, as a consequence, simpler to use.

Preferably the projection is hingedly moveable into a position to open the compartment.

Preferably the compartment is closeable in use with an openable seal. More preferably the projection least partially detaches the seal from the compartment. Most preferably the projection includes a cutter portion adapted for cutting the seal.

Preferably the engagement means is a protrusion located internally of the lid and externally of the compartment. More preferably the protrusion comprises at least one flange located on an external wall of the compartment and arranged to bias the projection into a location that opens the compartment as the lid is moved in the given direction.

Preferably the lid is rotatable relative to the receptacle. More preferably the lid is attached to the receptacle via rotation in a first direction and is detached via rotation in a second opposite direction, the second direction corresponding to said given direction.

Preferably the lid is adapted for threadable engagement with the receptacle.

Preferably the compartment is also adapted for access from another location other than via the seal. More preferably the access adaptation is a closeable orifice in an exterior surface of the lid. Most preferably a removeable or insertable disc is arrangable for engagement with a rim of the orifice in a closed position. Alternatively the access adaptation is a closeable projecting teat located at an exterior surface of the lid.

Preferably the projection is integral with the receptacle at the opening or part of an insert locatable in the receptacle opening. More preferably the insert is a sleeve positionable in a neck of the receptacle and the projection protrudes inwardly of the sleeve.

Most preferably the sleeve comprises:

- a mounting for holding the sleeve in a freely rotatable but axially fixed manner in relation to the lid;
- one or more deformable retaining means located externally of the sleeve for holding it in an associative frictional engagement at the opening of the receptacle;
- a rib flange located at an internal wall of the sleeve and arranged to abut the engagement means upon rotatable movement of the lid at the receptacle,
- wherein when the lid is rotated the engagement means abuts the rib flange and further rotation of the lid thus causes the lid and the sleeve to rotate together but only as allowed by the deformation of the retaining means, thereby detaching the sleeve from its association with the receptacle.

The operation of this apparatus in use means that no separate intervention by a user needs to occur to remove the projection from its association with the opening of the receptacle prior to consuming the receptacle contents.

Preferably the mounting comprises a circumferential or part-circumferential retaining rib located on the internal wall of the sleeve which in use is seated in a groove located on an outer surface of the compartment.

Preferably the lid is provided with a tamper-evident seal. More preferably the seal is a strip detachably positioned at an edge rim of the lid which adjoins the receptacle in use.

In a second aspect the present invention provides a method of opening a compartment located in a lid positionable at a receptacle, including the step of moving the lid in a given direction relative to the receptacle at an opening of the receptacle so that a projection associated with the receptacle is itself moved into a position to open the compartment.

In a third aspect the present invention provides a method of opening a compartment located in a lid positionable at an opening of a receptacle wherein movement of the lid in a unidirectional rotation alone with respect to the receptacle causes compartment opening followed by removal of the lid from the receptacle.

As a result, the method of opening the receptacle is simplified in comparison to the known prior art devices so that the user only needs to undertake one intuitive action of turning the lid of the receptacle to accomplish two separate functions immediately prior to use of the combined contents of the compartment and the receptacle.

Preferably the opening of the compartment brings it into fluid communication with the receptacle.

Preferably the method of the second and third aspect uses a device as defined in the first aspect.

In a fourth aspect the present invention provides a lid for location at an opening as defined in the first aspect.

In a fifth aspect the present invention provides a receptacle being fitted with a device as defined in the first aspect.

In a sixth aspect the present invention provides a sleeve which is insertable into an opening of a receptacle and having a projection as defined in the first aspect.

BRIEF DESCRIPTION OF THE DRAWINGS

Notwithstanding any other forms which may fall within the scope of the present invention, preferred forms of the invention will now be described, by way of example only, with reference to the accompanying drawings in which:

FIGS. 12*a* and 12*b* respectively show a perspective, and a side elevational view, both views being sectioned, of the in use assembly of lid, seal and sleeve of FIGS. 10 and 11 when fitted to a receptacle opening, the projection on the sleeve not yet moved from its initial position into its deployed position to cut the seal.

DETAILED DESCRIPTION OF THE INVENTION

Figure 1A:
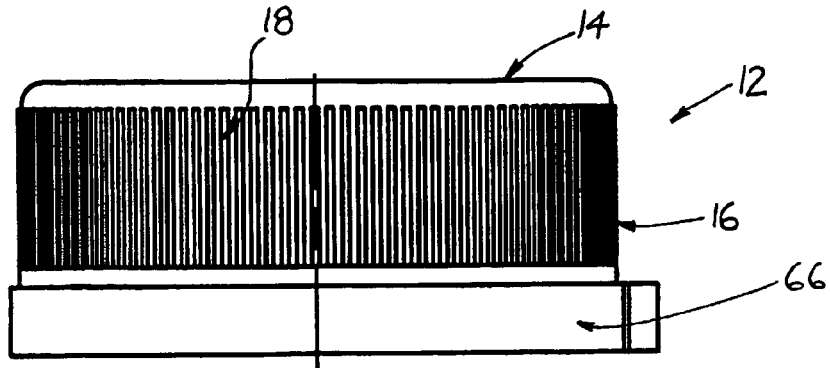
FIGS. 1*a*, 1*b* and 1*c* respectively show a side elevation, underside plan elevation and underside perspective view of one embodiment of a lid in accordance with the invention.
Figure 1B:
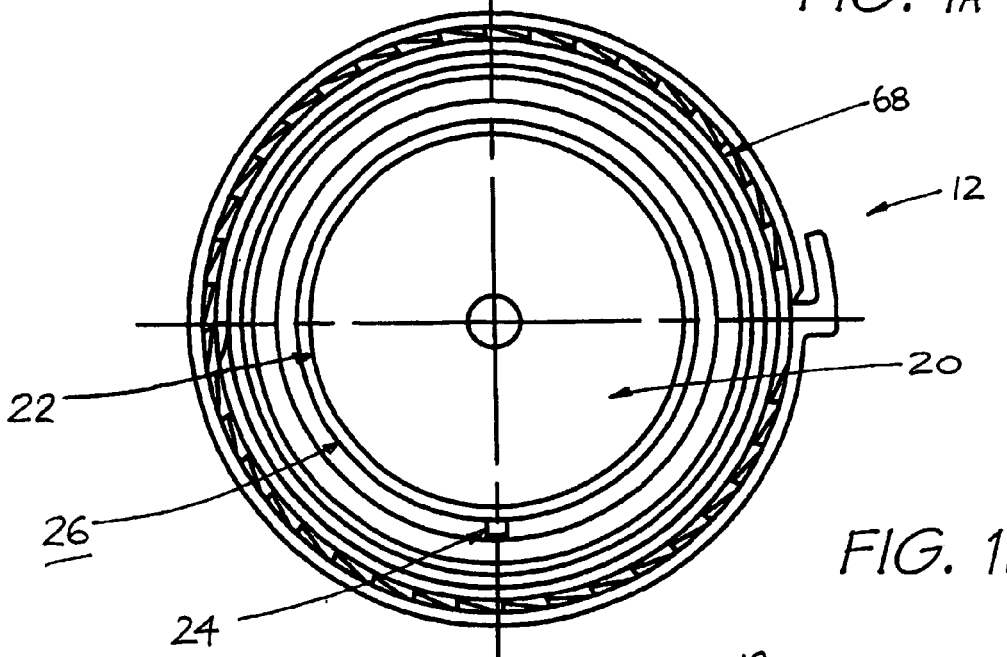
Figure 1C:
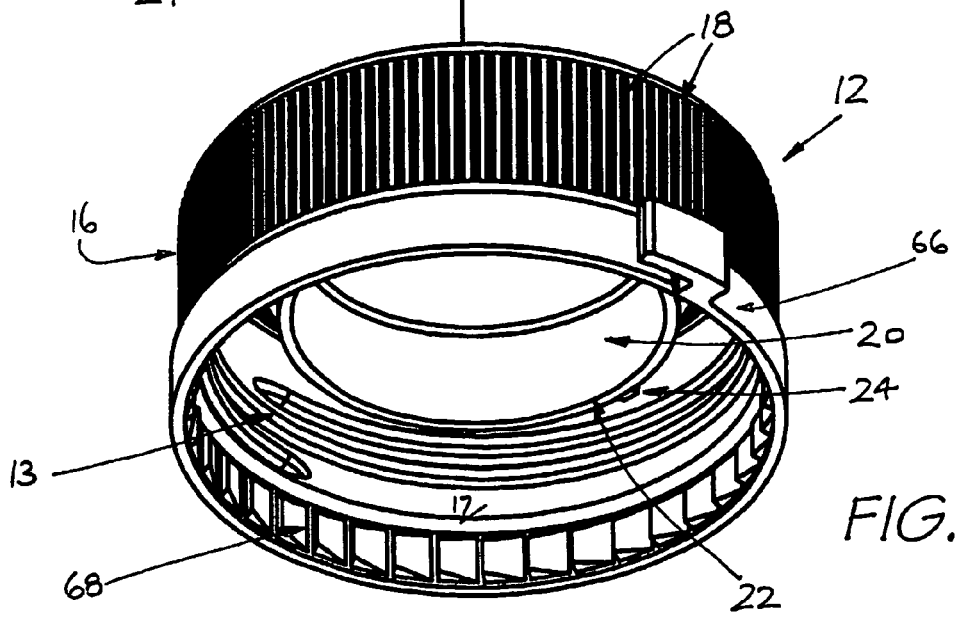
Figure 2:
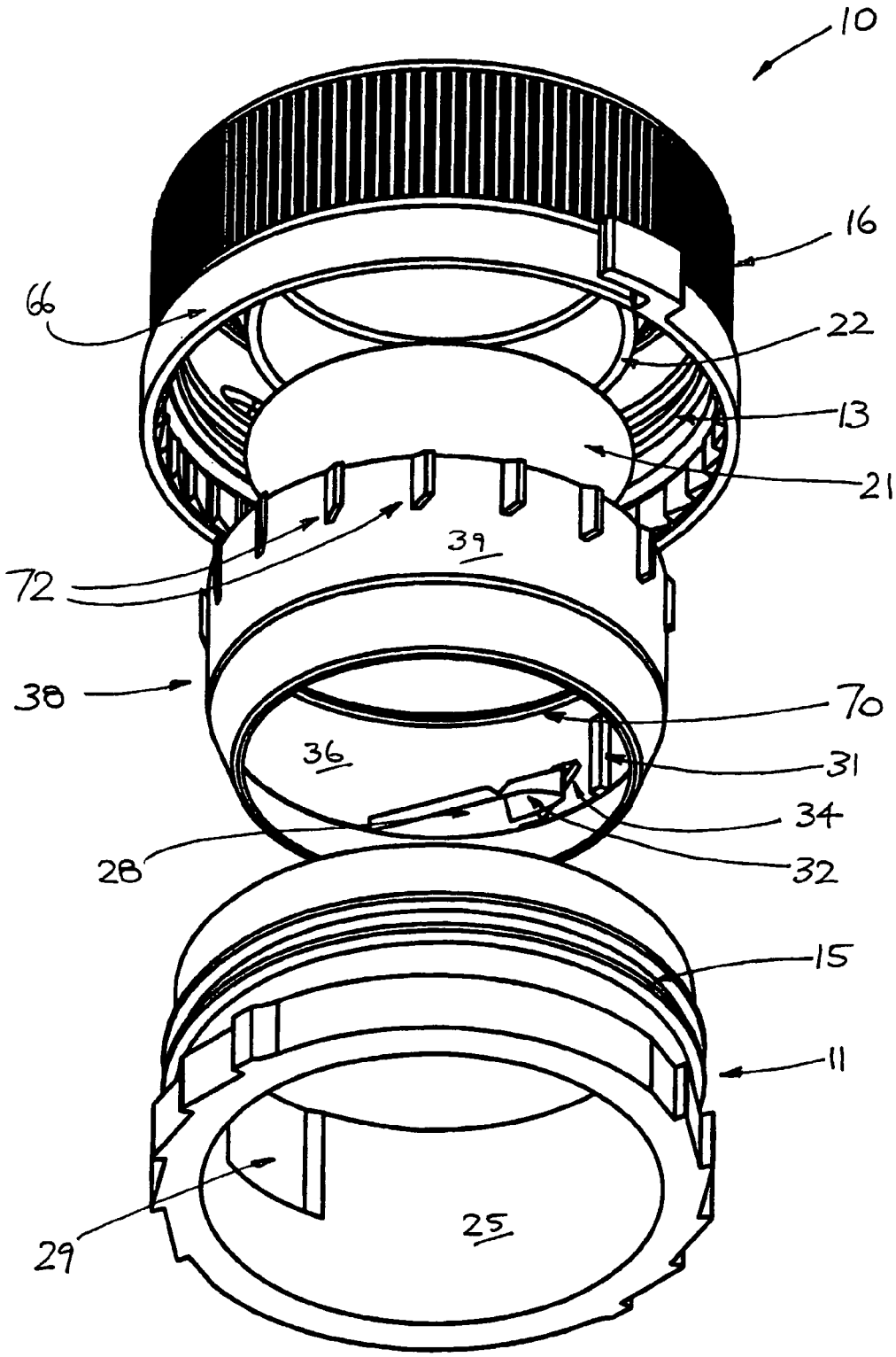
FIG. 2 shows a perspective exploded sectional view of the lid of FIG. 1 when fitted with an openable seal and a sleeve which is insertable into the opening of a receptacle as shown, the sleeve having a projection in accordance with the invention fitted thereto.
Figure 3A:
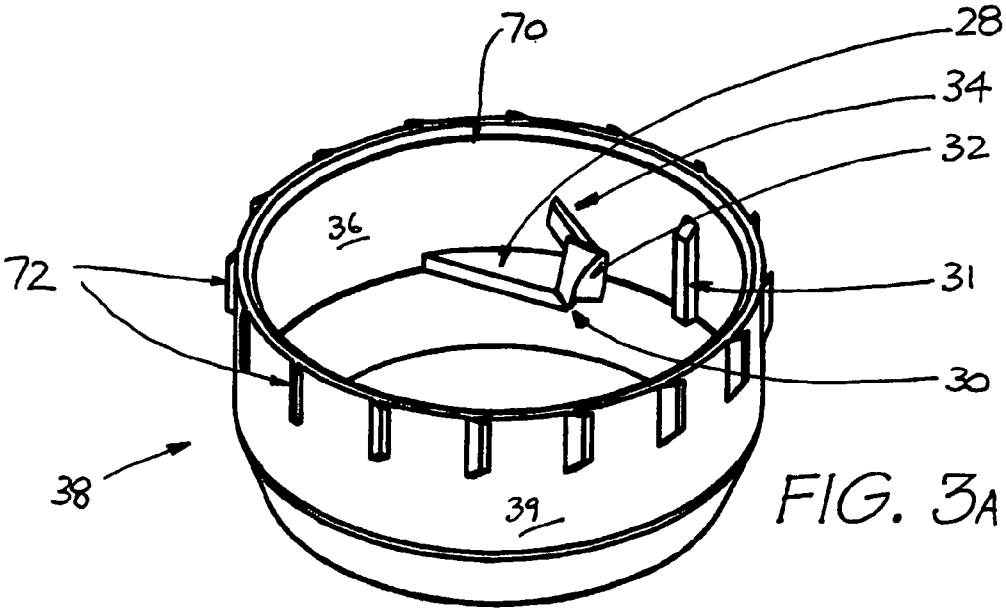
FIGS. 3*a*, 3*b* and 3*c* each show a perspective view of the sleeve of FIG. 2 which is insertable into the opening of a receptacle and having a projection fitted thereto in accordance with the invention, the projection being moveable into various positions as shown in the drawings.
Figure 3B:
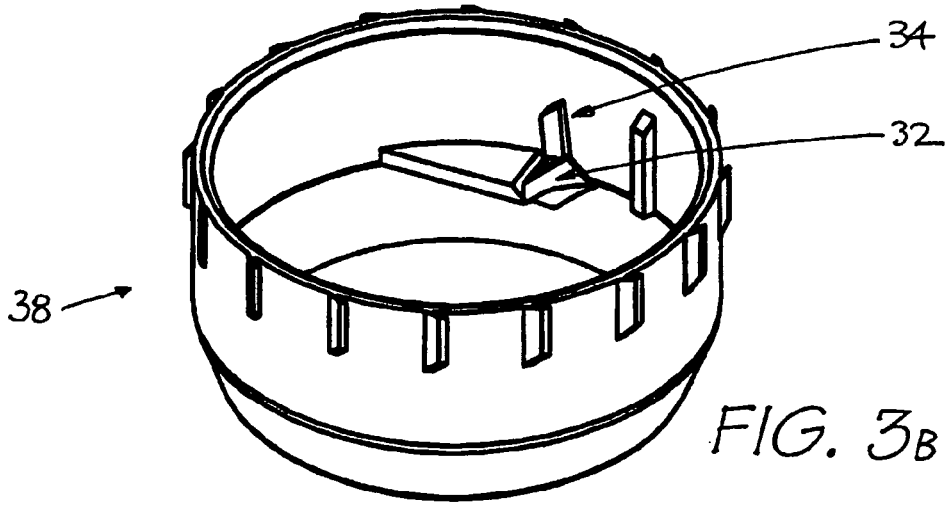
Figure 3C:
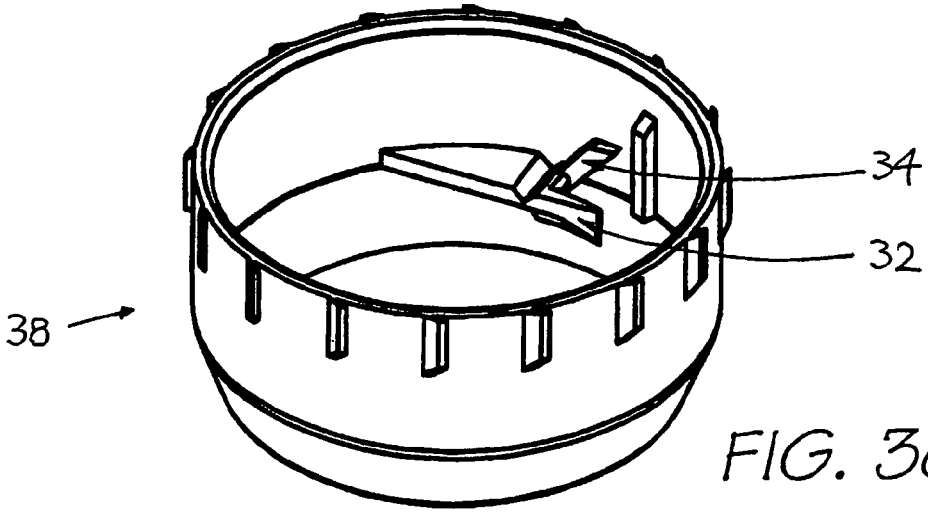
Figure 4A:
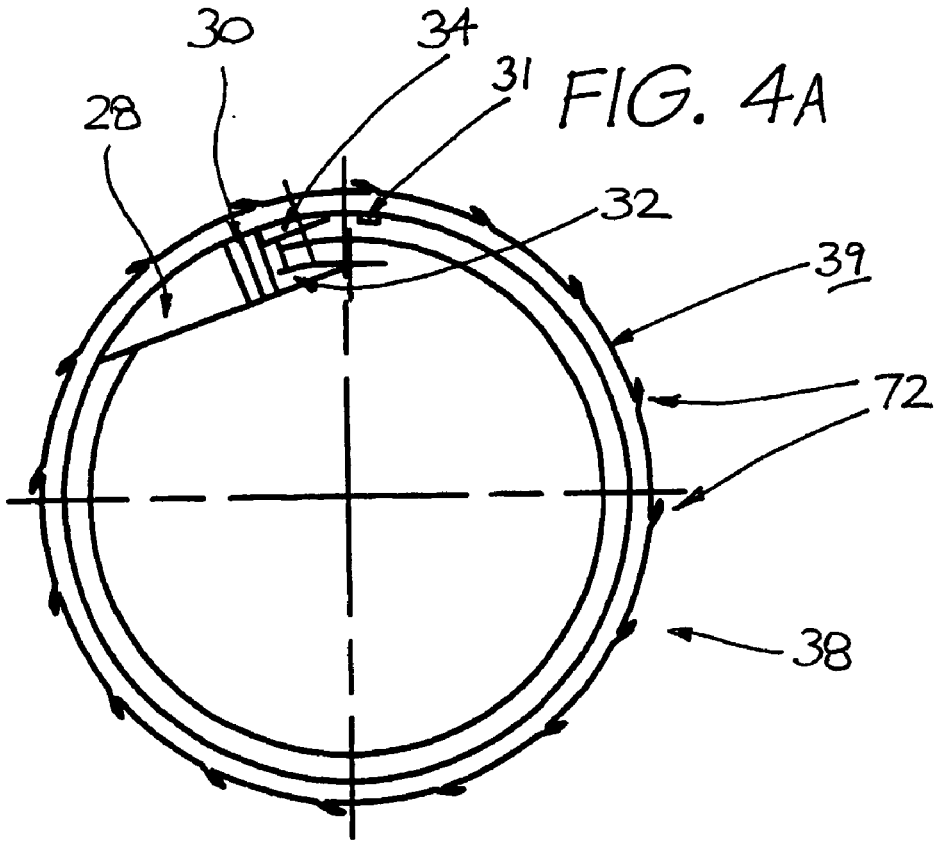
FIGS. 4*a* and 4*b* respectively show a plan and a side sectional view of the sleeve of FIG. 2.
Figure 4B:
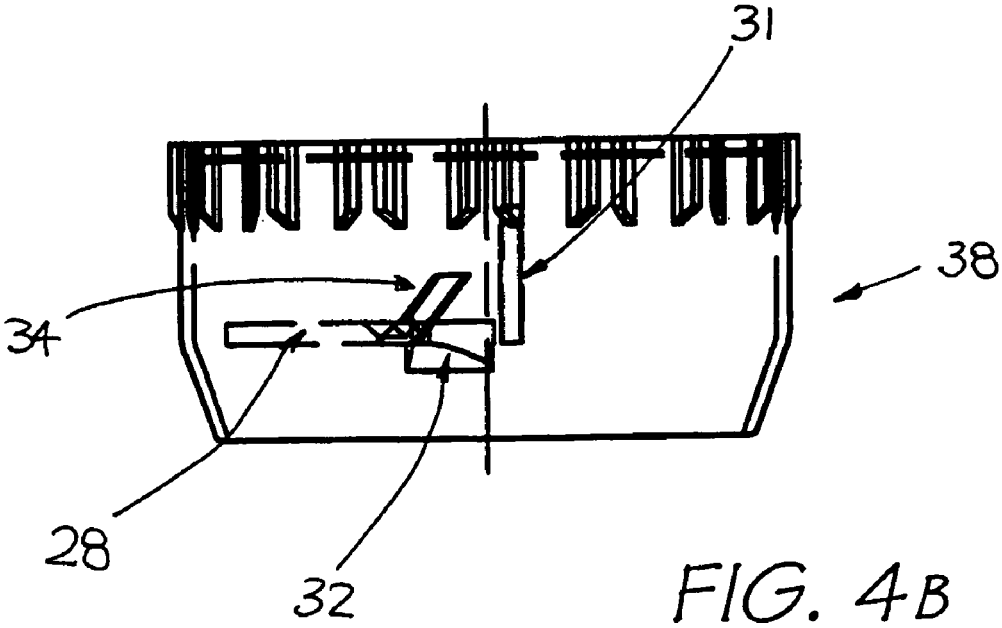
Figures 5A, 5B, 5C:
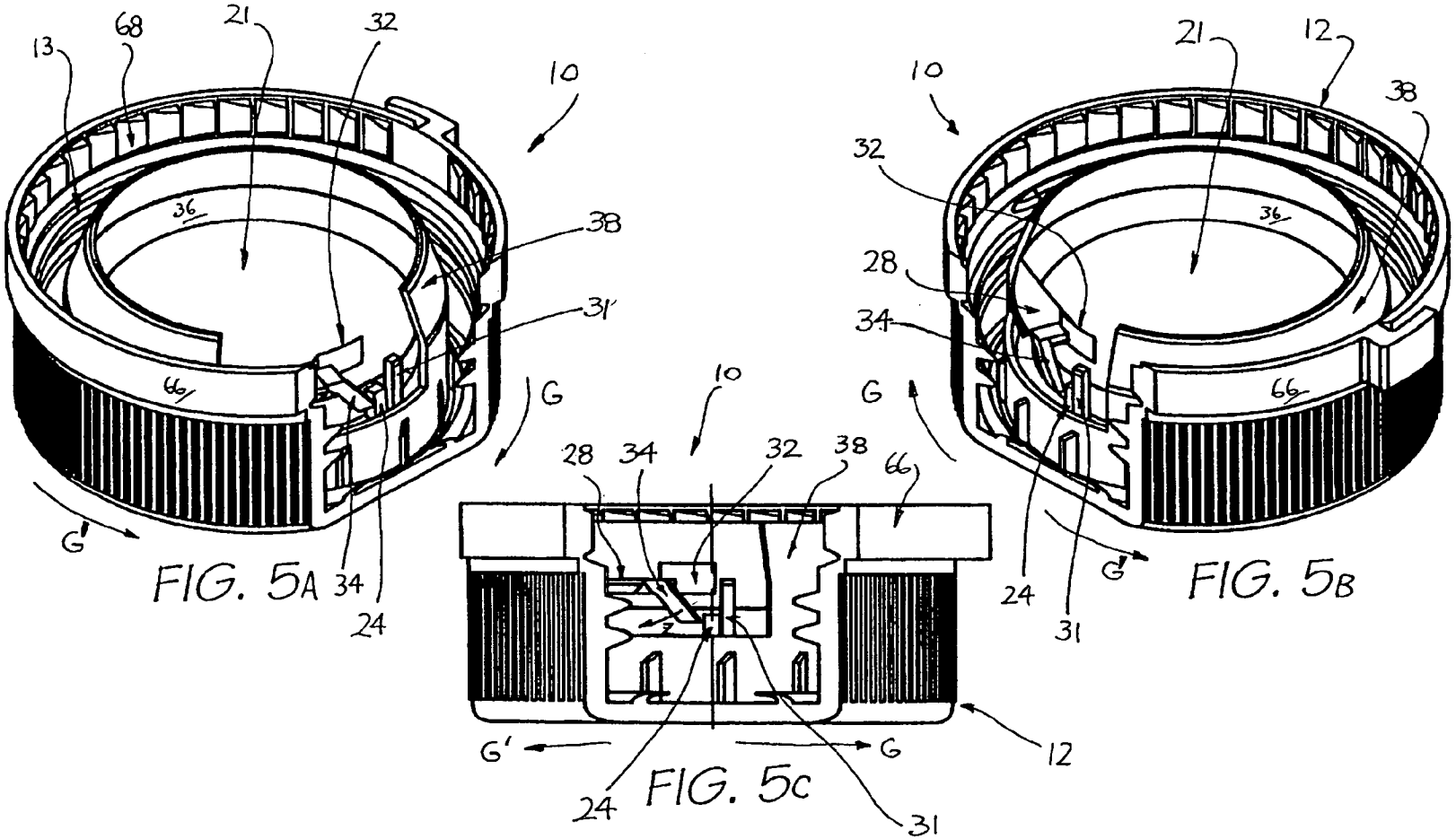
FIGS. 5*a*, 5*b* and 5*c* respectively show a perspective, another perspective and a side view, all views being partially sectioned, of the in use assembly of lid, seal and sleeve of FIG. 2, the projection on the sleeve not yet moved from its initial position.
Figures 6A, 6B, 6C:
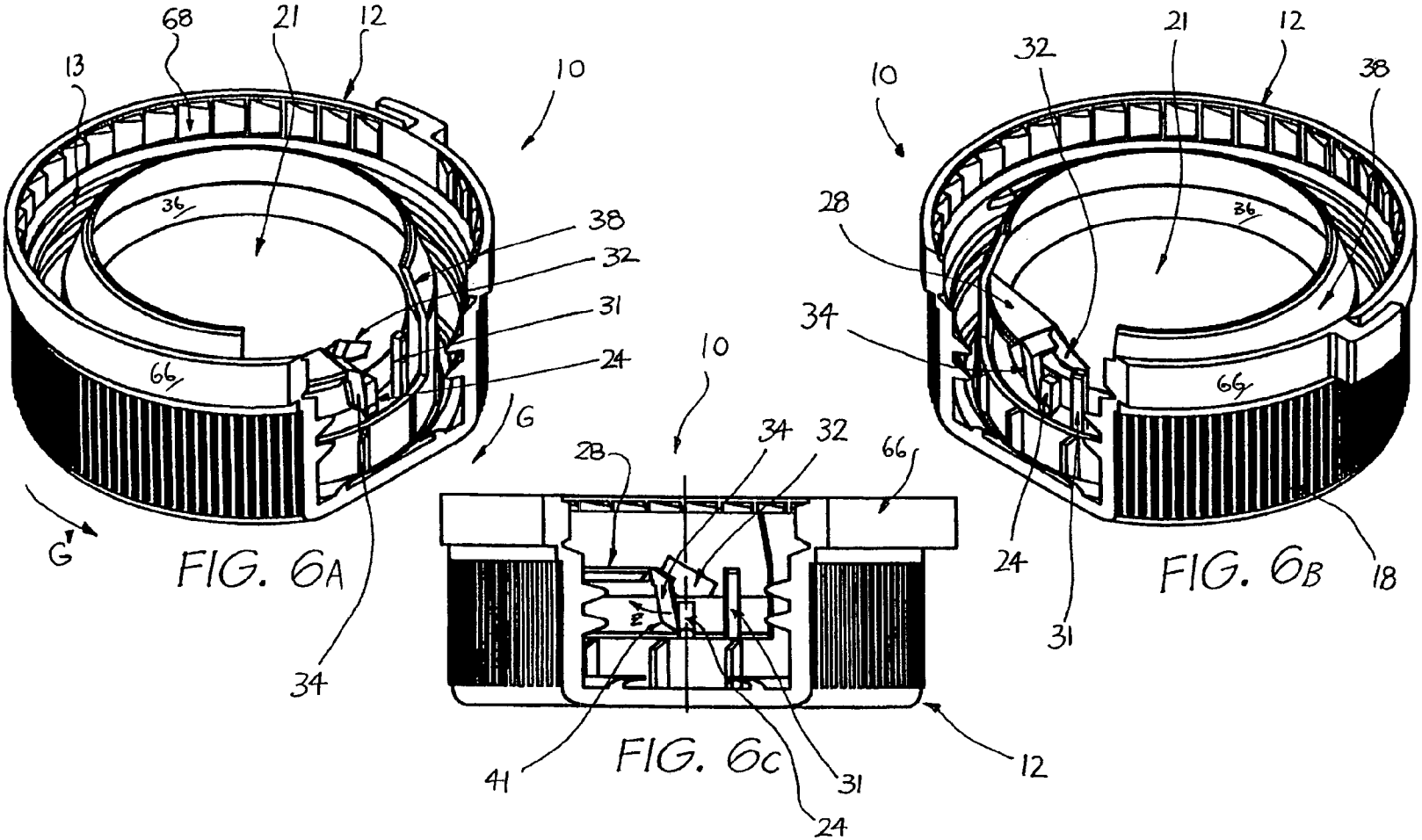
FIGS. 6*a*, 6*b* and 6*c* respectively show a perspective, another perspective and a side view, all views being partially sectioned, of the in use assembly of lid, seal and sleeve of FIG. 2, the projection on the sleeve being partially moved from its initial position into its deployed position to cut the seal.
Figures 7A, 7B, 7C:
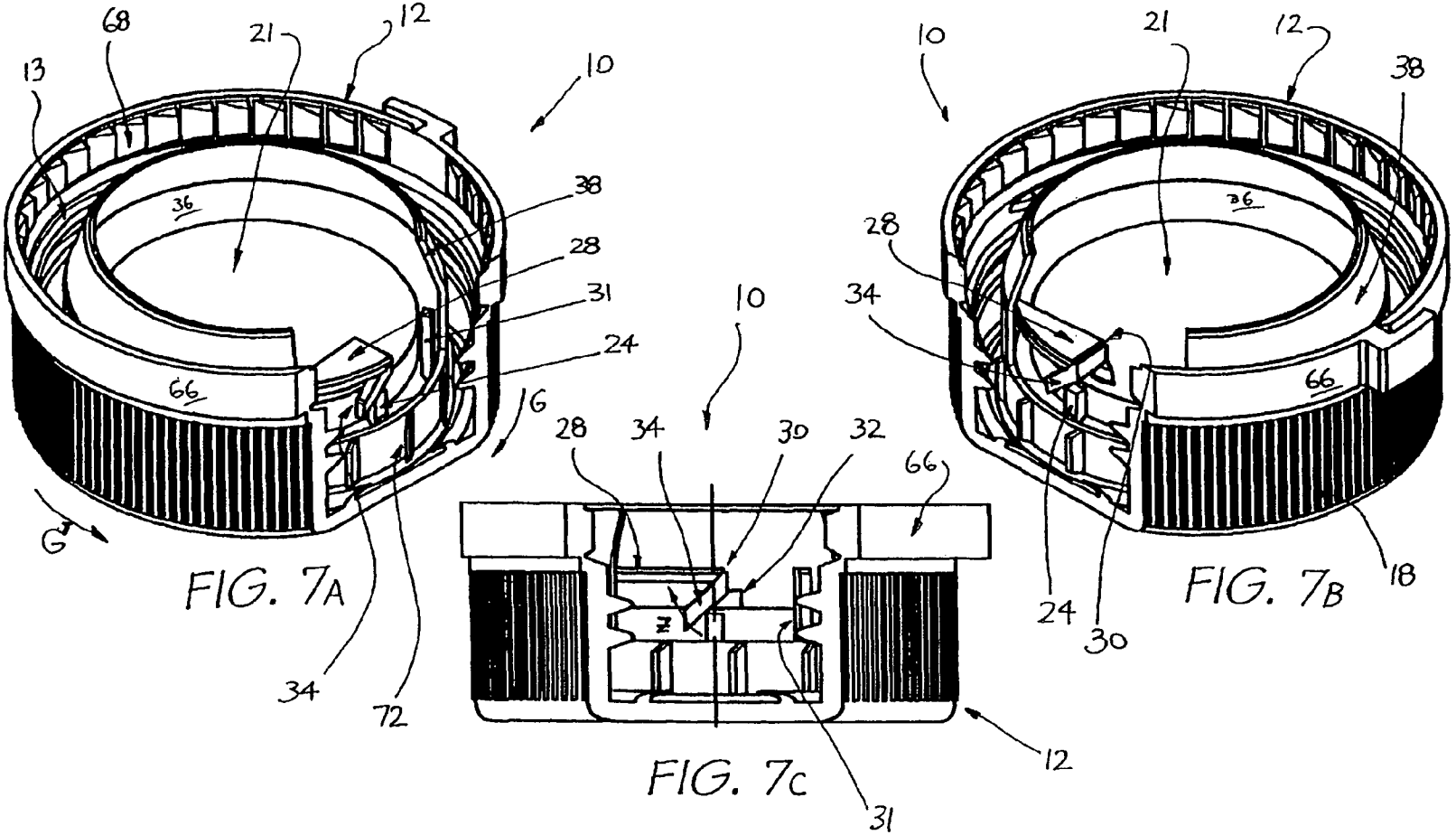
FIGS. 7*a*, 7*b* and 7*c* respectively show a perspective, another perspective and a side view, all views being partially sectioned, of the in use assembly of lid, seal and sleeve of FIG. 2, the projection on the sleeve being fully moved from its initial position into its deployed position to cut the seal.

Referring to the drawings, a device 10 is shown for location at an opening throat 11 of a receptacle such as a bottle or other storage container. The device 10 includes a lid 12 for location at the opening throat 11. The lid has a circular top plate 14 and a skirt 16 depending therefrom, the exterior surface of the skirt 16 having longitudinal ribs or grooves 18 to facilitate finger grip by a user. The interior of the lid 12 includes a centrally-located circular compartment 20 that is positionable at the opening 11 when the lid 12 is located thereat. Typically the compartment 20 is closed by an openable seal such as a foil or plastic membrane 21 which is affixed to the edge rim 22 of the compartment 20 by an appropriate sealant, such as an adhesive, or as a result of a welding process (i.e. conductively or inductively welded).

The interior surface 17 of the skirt 16 of the lid 12 includes a threaded formation 13 which in use is mated to a threaded formation 15 located at the exterior surface of the opening throat 11 of the receptacle, to retain the lid thereat. The lid is fitted to or removed from the opening throat 11 by rotation to respectively couple or to decouple the mating threads 13, 15.

In use the compartment 20 contains a substance which is designated for mixing with a fluid which is located in the receptacle. The seal 21 maintains a barrier to fluid communication between the substance and the fluid in the receptacle until such time as the device 10 is actuated and the seal 21 is broken, as will be described.

The device 10 also includes a projection in the form of a support flange 28 which is joined via a thin section hinge 30 to a hingedly moveable cutter 32 and associated deflection arm 34. In the preferred embodiment, the support flange 28, moveable cutter 32 and deflection arm 34 are positioned on and are integral with the interior surface 36 of a circular cross-sectional sleeve 38 which is inserted into the receptacle throat opening 11.

The lid 12 also includes engagement means in the form of a longitudinal rib 24 which projects outwardly from the external wall 26 of the compartment 20. When assembled, there is at least a small clearance distance between the interior surface 36 of the sleeve 38 and the longitudinal rib 24, in order to allow relative movement therebetween. The longitudinal rib 24 on the compartment 20 external wall 26 is arranged in use to interact with the deflection arm 34 so as to bias the cutter 32 into a position that opens the sealed compartment 20, as will be described.

Figure 16:
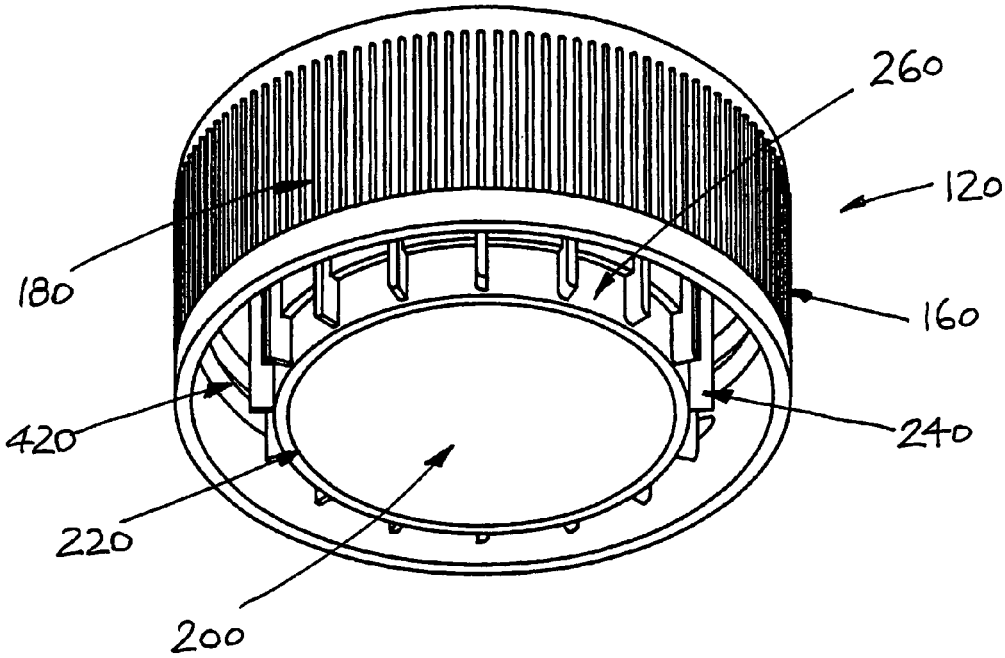
FIG. 16 shows a perspective view of a further embodiment of a lid in accordance with the invention.
Figure 17:
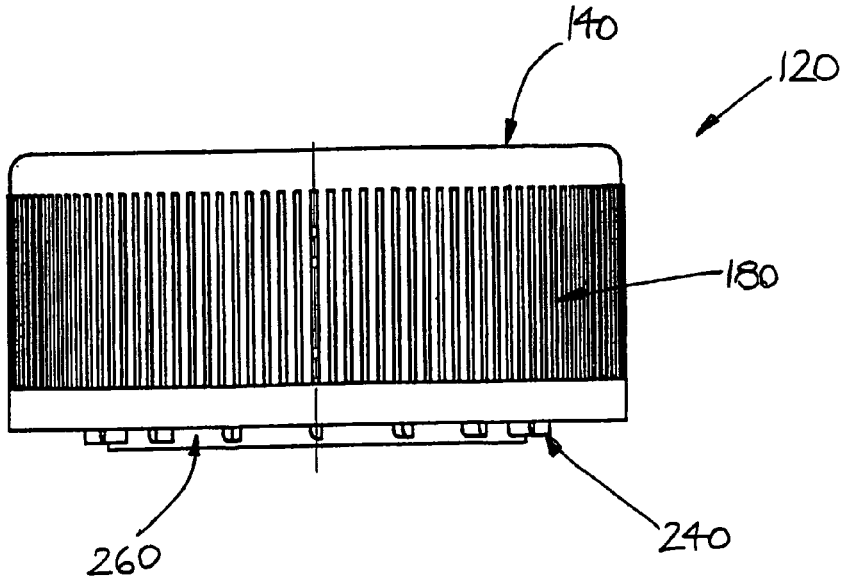
FIG. 17 shows a side elevational view of the lid shown in FIG. 16.
Figure 18:
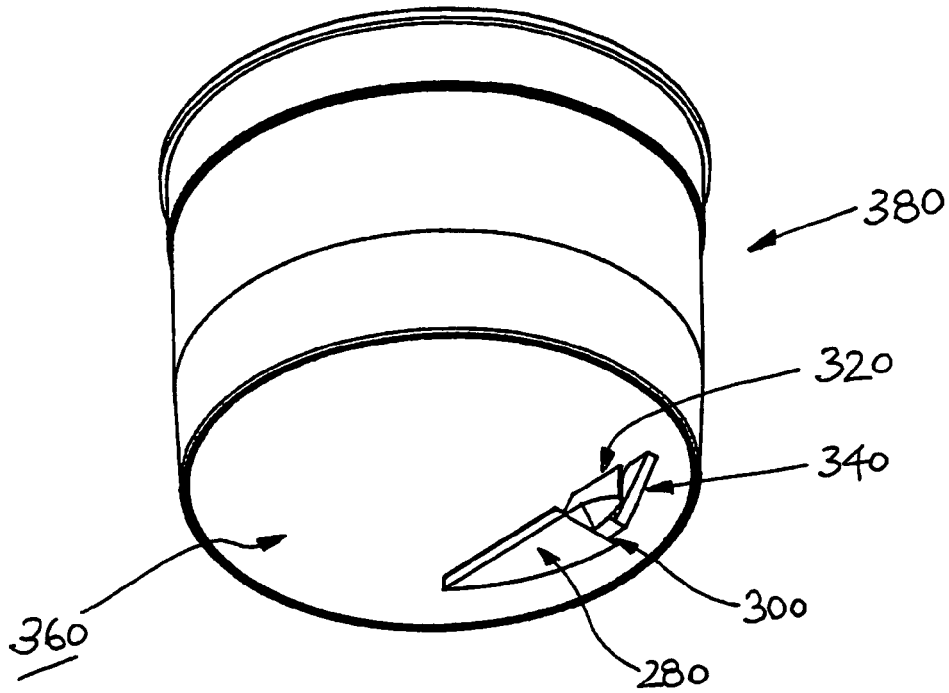
FIG. 18 shows a perspective view of one embodiment of a sleeve which is insertable into the opening of a receptacle and having a projection fitted thereto in accordance with the invention.
Figure 19:
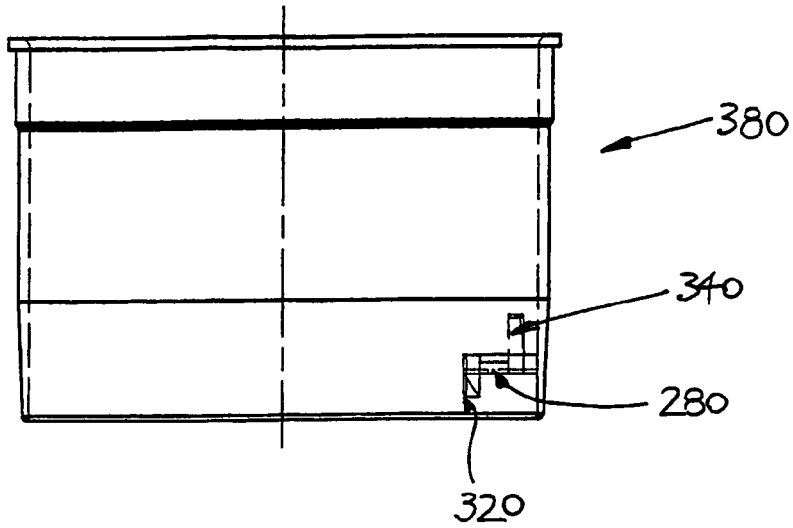
FIG. 19 shows a side elevational view of the sleeve shown in FIG. 18.

In further embodiments, multiple longitudinal ribs or other protrusions of some kind can be arranged on the external wall of the compartment (for example, see FIGS. 16 and 17) to function as an engagement means.

The sleeve 38 also has a mounting in the form of a circumferential retaining rib 70 located on the internal wall 36 of the sleeve 38 and a groove 71 located on the external wall 26 of the compartment 20 in which the retaining rib 70 is received and seated in use. The retaining rib 70 is freely rotatable within said groove 71 in use so that the lid (and compartment) can be turned with respect to the sleeve 38 since there is a narrow annular clearance gap between the external wall 26 of the compartment 20 and the interior surface 36 of the sleeve 38. By seating the rib 70 in the said groove 71 on the external wall 26 of the compartment 20, the sleeve 38 is axially fixed in one location in relation to the compartment 20 and thus the lid 12. In further embodiments the mounting can be present in other forms, for example including a partial circumferential retaining rib.

The sleeve 38 also has a deformable retaining means in the form of a plurality of elongate flanges 72 located at the external wall 39 of the sleeve 38 and projecting outwardly therefrom. In the preferred embodiment shown, these elongate flanges 72 are arranged tangentially to the external wall 39 so as to provide a frangible, frictional interfit for retention of the sleeve 38 at the interior surface 25 of the throat 11, and to generally prevent the relative rotation of the sleeve 38 in the throat 11 whilst the cap 12 is being unscrewed from the throat 11, and whilst the compartment 20 is thus being rotated with respect to, and internally of, the sleeve 38. The recesses 29 located at the interior surface 25 of the throat 11 can also assist the interfit of the elongate flanges 72 with the throat 11 by partial receipt of those flanges 72.

In further embodiments, protrusions of different shapes and orientations other than the tangential elongate flanges 72 can be used. For example, dimples can be arranged on the external wall of the sleeve for receipt in shallow cavities positioned on the interior surface of the throat, as long as the sleeve is initially held in an associative frictional engagement with the throat of the receptacle. Since the association of the sleeve with the receptacle throat can vary somewhat depending upon the ambient temperature, or with the manufacturing tolerances of the various components, the use of protrusions on the external wall of the sleeve is preferred compared with the use of smooth-walled sleeves.

The sleeve 38 also has a rib flange 31 located at its interior surface 36 and which is arranged to abut the longitudinal rib 24 at some point during rotatable movement of the lid 12 at the receptacle. The function of this rib flange 31 during unscrewing of the lid 12 from the throat 11 of the vessel will be described.

In other embodiments the support flange, moveable cutter and deflection arm can be arranged to be integrally formed at the interior surface of the opening of the receptacle, or even as part of a partial sleeve insertable in the receptacle mouth. In still other embodiments there can be more than one projection including the support flange, moveable cutter and deflection arm located at the receptacle or sleeve interior surface.

The operation of the component parts of the device 10 in use will now be described. In the preferred embodiment, and as best shown in the series of FIGS. 5 to 8 which show the sequential position of the various parts of the device during use, a user grips and rotates the lid 12 in relation to the receptacle in a given direction G. The threaded formation 13 of the lid 12 is thus moved in the direction of disengagement from the threaded formation 15 at the throat 11 of the receptacle. As the lid 12 is rotated, it is moved relative to the receptacle and to the sleeve 38 associated with the receptacle, the sleeve 38 being mounted via the deformable elongate flanges 72 which frictionally engage the sleeve with the opening throat 11 of the receptacle. The rotation of the lid 12 with respect to the sleeve 38 is also guided by the motion of the circumferential retaining rib 70 of the sleeve 38 within the groove 71 located on the external wall 26 of the compartment 20 of the lid 12. The lid 12 is thus turned with respect to the sleeve 38 without axial displacement therebetween.

During the rotational motion of the lid 12 in direction G, the longitudinal rib 24 located at the exterior of the compartment is moved in contact with the projecting deflection arm 34 of the sleeve. As rotation of the lid 12 continues in direction G, the deflection arm 34 is hingedly moved in the direction of arrow Z (see sequential FIGS. 5 to 8 where the movement is clearly shown). This movement causes a likewise hinged deployment of the associated cutter 32 about hinge 30. The cutter 32 moves into contact with the openable seal 21 and breaks the seal 21 (see FIG. 6). As the lid 12 is further rotated in the given direction G, the stationary cutter 32 is moved to further break or cut the seal at or near the edge rim 22 of the compartment 20. At some point sufficient of the seal is cut, torn or detached to allow a substance held in the compartment 20 to pass into the adjoining receptacle, so that mixing can commence.

In further embodiments the projection can include parts other than a cutter, for example a piercing element such as a spike which can break the openable seal and allows a gaseous, liquid or powdered substance to flow from the compartment 20 into the adjoining receptacle such as a bottle or container. The actuation of the projection can be by one or more engagement ribs of different shapes or configurations than the rib 24 positioned on the compartment 20 in the preferred arrangement. In still further embodiments, the deflection of the cutter can occur by other than a hinging action, for example the engagement means can act on a trigger release associated with the projection to move at least a portion of the projection so as to open the seal.

Figure 8B:
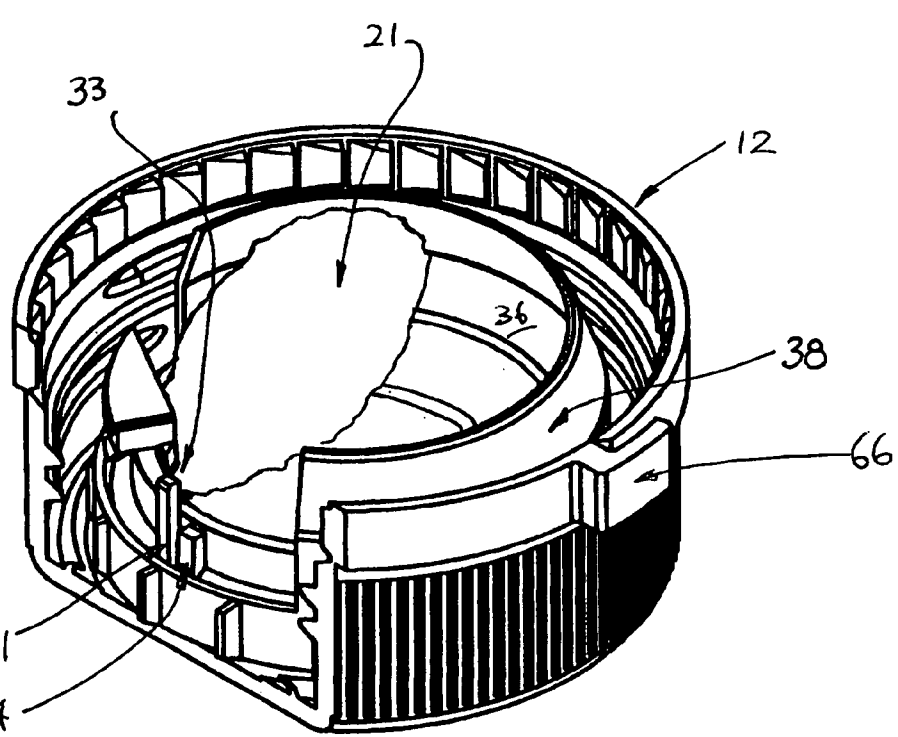
FIGS. 8*a* and 8*b* respectively show a perspective, and another perspective view, both views being partially sectioned, of the in use assembly of lid, seal and sleeve of FIG. 2, the projection on the sleeve having been rotated with respect to the lid so that the seal is cut open to release the contents of the compartment in use.
Figure 8A:
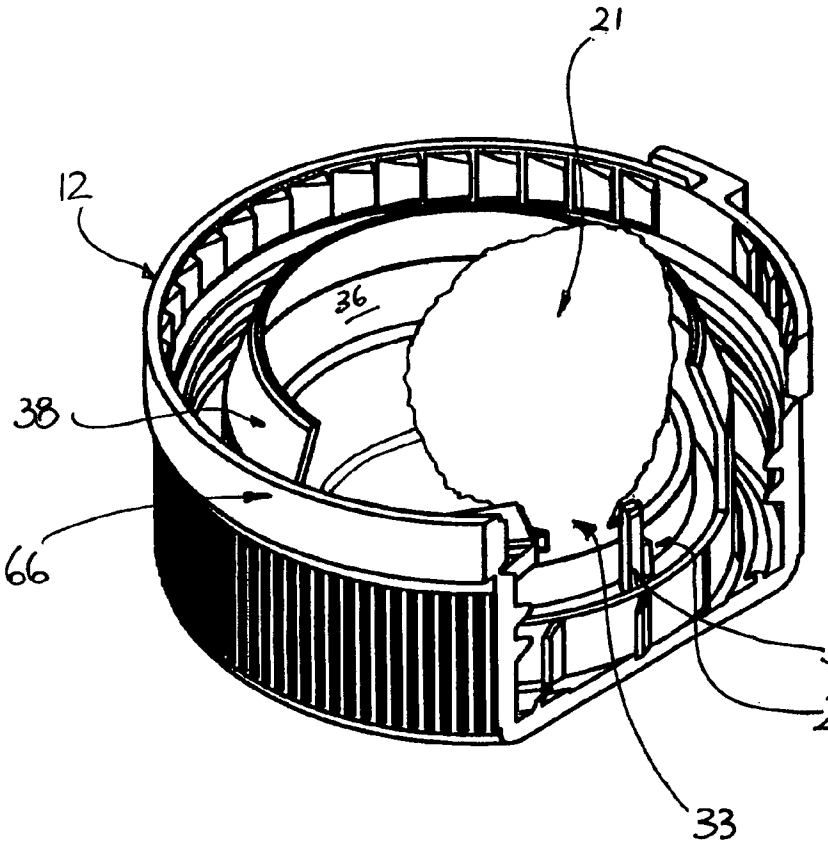
Figure 9B:
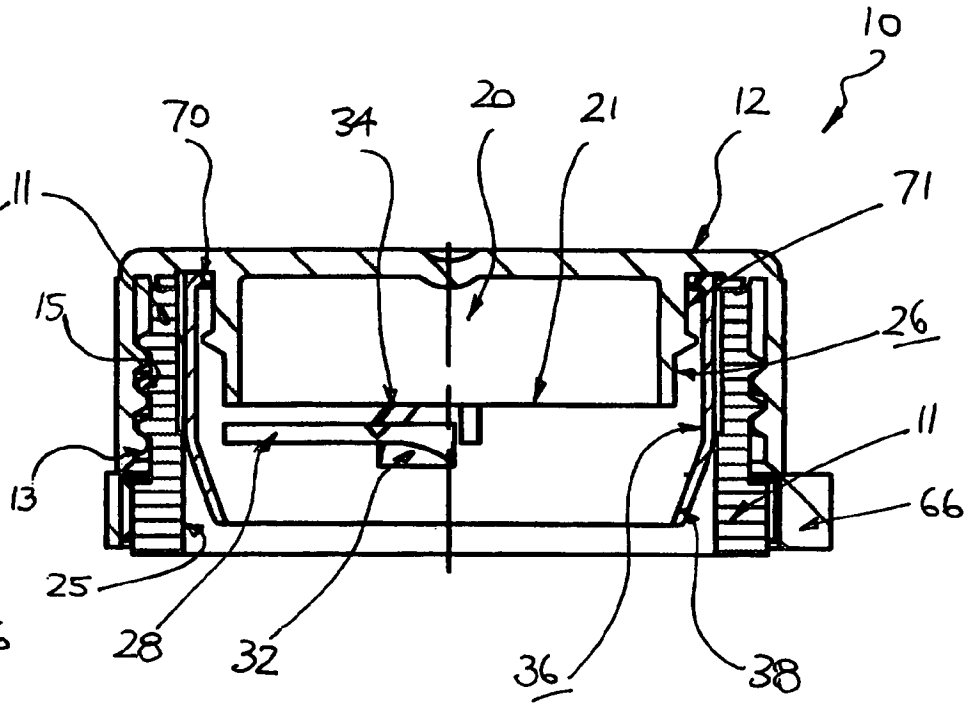
FIGS. 9*a* and 9*b* respectively show a perspective, and a side elevational view, both views being sectioned, of the in use assembly of lid, seal and sleeve of FIG. 2 when fitted to a receptacle opening, the projection on the sleeve not yet moved from its initial position into its deployed position to cut the seal.
Figure 9A:
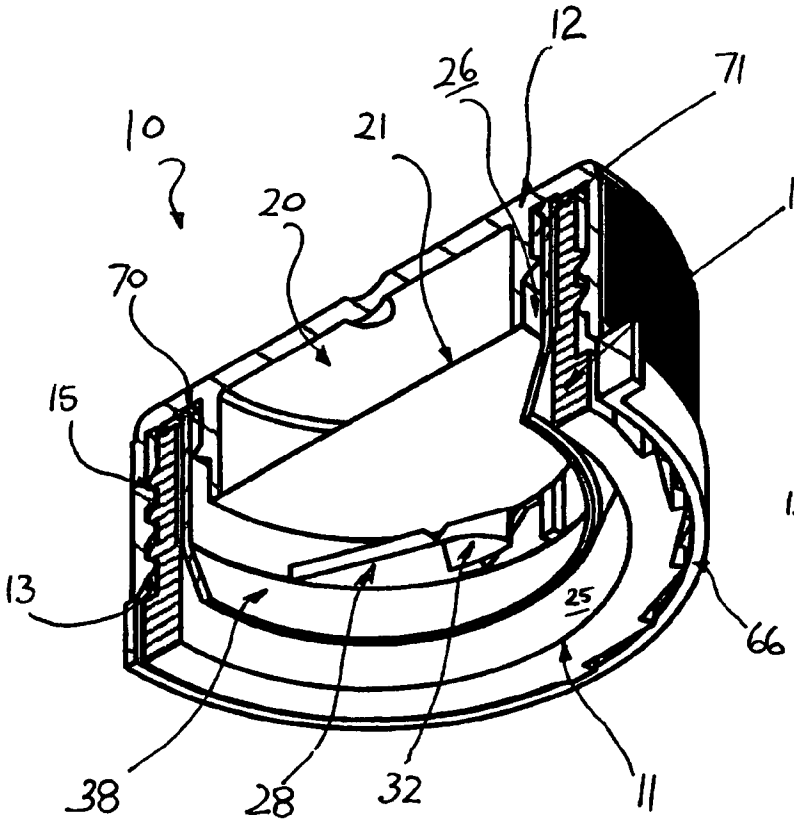

When the openable seal is cut it is undesireable for the seal 21 to completely detach from the edge rim 22 of the compartment 20, especially if the receptacle contains foodstuffs or items for human use. To ensure that this does not occur, as the lid 12 and compartment 20 are rotated in the given direction G, the longitudinal rib 24 on the external wall 26 of the compartment eventually comes into abutment with the rib flange 31 which is located at the interior surface 36 of the sleeve 38, the sleeve 38 being, up to this point, stationary with respect to the receptacle. Once said abutment occurs, further rotational cutting of the seal 21 is prevented, as the abutment of the rib 24 and rib flange 31 prevents the further act of rotation of the lid 12 relative to the sleeve 38/receptacle as is best shown in FIG. 8. A narrow bridge width 33 of seal material remains uncut, and thus the remainder of the seal 21 is retained at the compartment 20. At the point where sufficient of the seal 21 is cut, torn or detached to allow a substance held in the compartment 20 to pass into the adjoining receptacle, mixing of the substance and the receptacle contents can commence.

In the preferred embodiment of the device 10, the abutment of the rib 24 located on the external wall 26 of the compartment 20 and the rib flange 31 on the interior surface 36 of the sleeve 38 can also allow the sleeve 38 to be removed from its association with the receptacle. As the user applies an additional force to further rotate the lid in the direction G so that the longitudinal rib 24 pushes harder against the rib flange 31, this results in the lid 12 and the sleeve 38 rotating together but only as allowed by the deformation of the elongate flanges 72 which are frictionally engaged with the interior surface of the opening throat 11 of the receptacle. These flanges 72 bend sufficiently under the applied force from the user to thereby allow detachment of the sleeve 38 from its frictional association with the receptacle. At that point, the circumferential retaining rib 70 of the sleeve 38 which is located in the groove 71 on the external wall 26 of the compartment 20 of the lid 12, acts to prevent axial displacement of the sleeve 38 with respect to the compartment 20 of the lid 12, and so maintains the freed sleeve 38 in position with respect to the lid 12. Thus, advantageously, the user may then discard the lid 12 and sleeve 38 which includes the cutter 32, and consume fluid directly from the throat opening 11 of the receptacle without either separately having to remove the sleeve 38/cutter 32 by hand, or risking injury to the lips or mouth of the user by drinking out of the receptacle fitted whilst with the cutter 32 at or adjacent the mouth thereof.

It is further noted that, in the preferred embodiment shown in the drawings, the length of each screw thread 13/15 used to engage the lid 12 at the throat opening 11 is calculated equivalent to the circumferential distance which the longitudinal rib 24 travels until its abutment with the rib flange 31 occurs. In other words, the lid and receptacle threads (respectively 13, 15) become disengaged at the same point at which the cutting of the seal 21 by the cutter 32 ceases, leaving an uncut narrow width bridge 33 of seal material 21.

When the lid 12 is initially attached to the opening of the receptacle, it is located thereon by rotation in a direction G' which is opposite to the aforementioned given direction G for unscrewing the lid 12 (which also causes an opening of the seal 21). Because of the initial angle of orientation of the deflection arm 34, when the lid 12 is moved in the direction G' it is not caused to deflect and thus to move the cutter 32 into a position of breaking the seal 21 (see FIG. 5, for example). The movement of the deflection arm 34 over and past the longitudinal rib 24 in the direction G' is facilitated by a slight rounding of the trailing edge 41 of the deflection arm 34, as shown in the FIG. 6*c*.

In further embodiments the lid need not be attached to the receptacle by a threadable coupling, but can simply be a 'bump on' lid which is snapped on, but which can still rotate to cause opening of the compartment in direction G.

Figure 10:
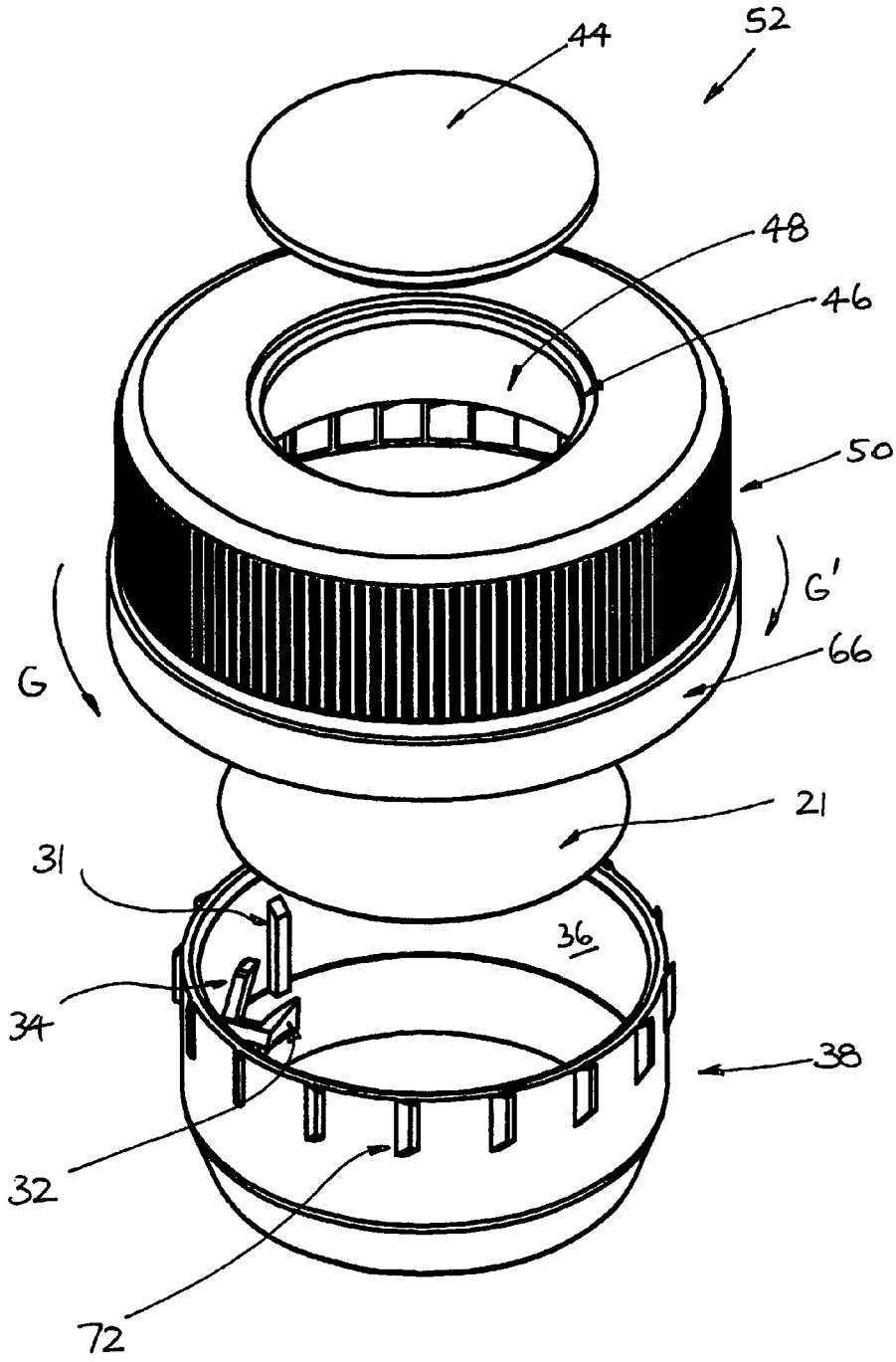
FIG. 10 shows a top perspective, exploded, sectional view of a further embodiment of a lid in accordance with the invention, the lid fitted with an openable seal and a sleeve which is insertable into the opening of a receptacle, the sleeve having a projection in accordance with the invention fitted thereto; the lid also having a second openable access orifice.
Figure 11:
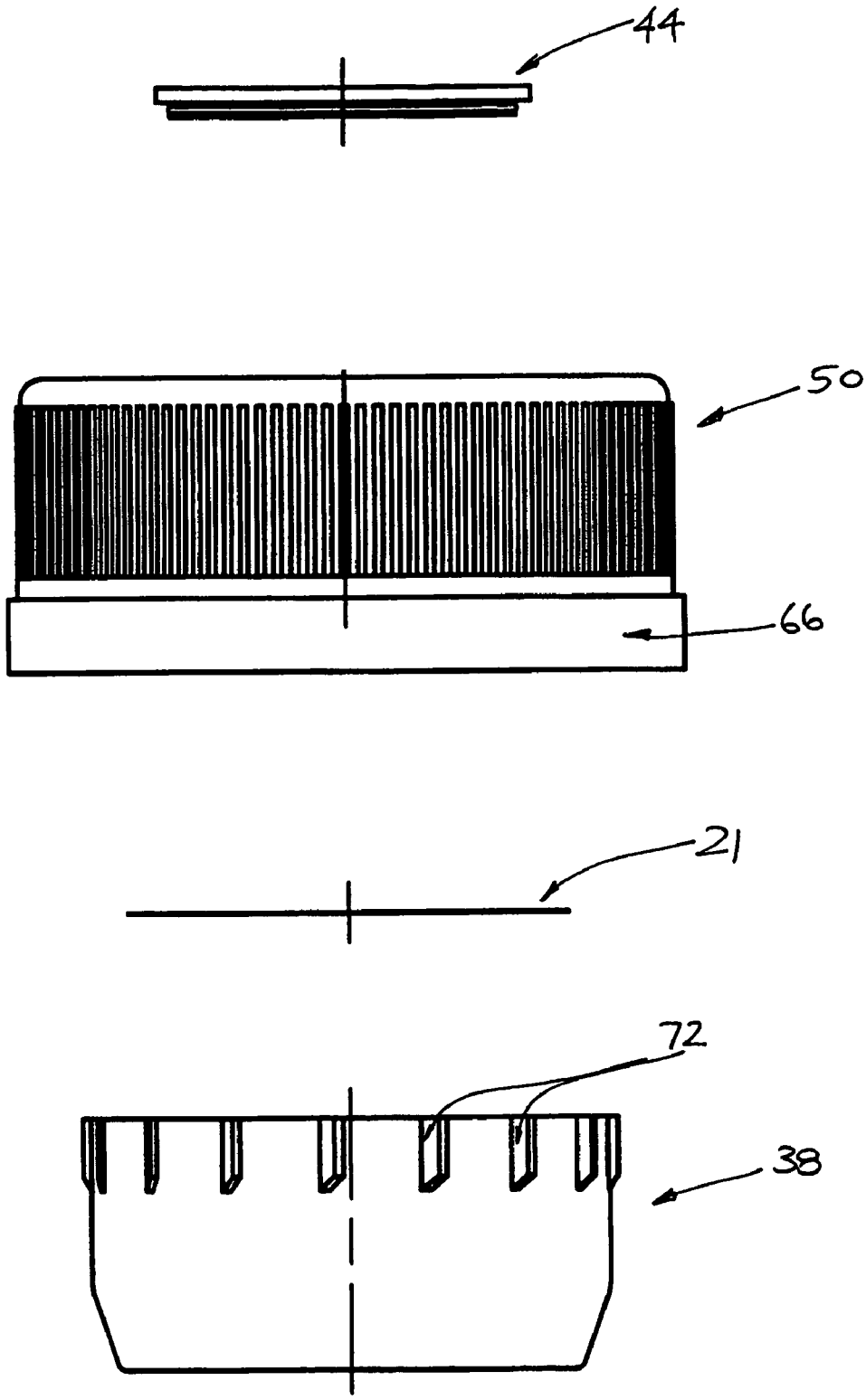
FIG. 11 shows a side elevational view of the embodiment of FIG. 10.

In further embodiments shown in FIGS. 10 to 15, the compartment 20 in the lid can have a second opening to allow access thereinto, other than via the seal at the edge rim 22. FIGS. 10 to 12 show one such embodiment of the invention 52 where like parts shown in previous embodiments have like numbers. In this embodiment, the lid 50 is arranged for additional access to the compartment 20 via a closeable orifice 48 in the circular top plate 14 of the lid 50. As shown in these Figures, a removeable or insertable disc 44 is arranged for engagement with a rim 46 of the orifice 48 when located in a closed position. The compartment 20 can thus be accessed from both within the receptacle to which the lid 50 is attached, and from outside the lid 50. In further embodiments the disc can be hinged to the rim 46 of the orifice 48 by, for example, a plastic hinge, so that it is not entirely removeable but simply frictionally fittable to the orifice 48.

Such an embodiment 52 is useful if a lid manufacturer wishes to provide a lid 50 already fitted with an openable seal in the form of a foil or plastic membrane 21. Thus the purchaser of lids 50 (for example the actual bottler/supplier of drinks or medicines etc.) can insert the desired substance into the lid 50 compartment 20 via orifice 48 and replace/insert the disc 44 without needing to themselves go to the expense of developing, say, a foil membrane applicator or process for use once the substance has been placed in the compartment 20.

Once the lid 50 itself has been rotated in direction G to actuate the deployment of the cutter 32, and the mixing of the substance in the compartment with the fluid in the receptacle has been accomplished, a user of the combined fluid and substance can either remove the lid 50 entirely or restore the lid 50 to its tightened position by rotation in the direction G' and then remove (or hingedly open) the insertable disc 44 in order to be able to access the mixture via the narrower opening of orifice 48. The orifice 48 may be more useful to drink or dispense liquid out of in some situations, for example while the user is in motion and spillage is preferably minimised.

Figure 13:
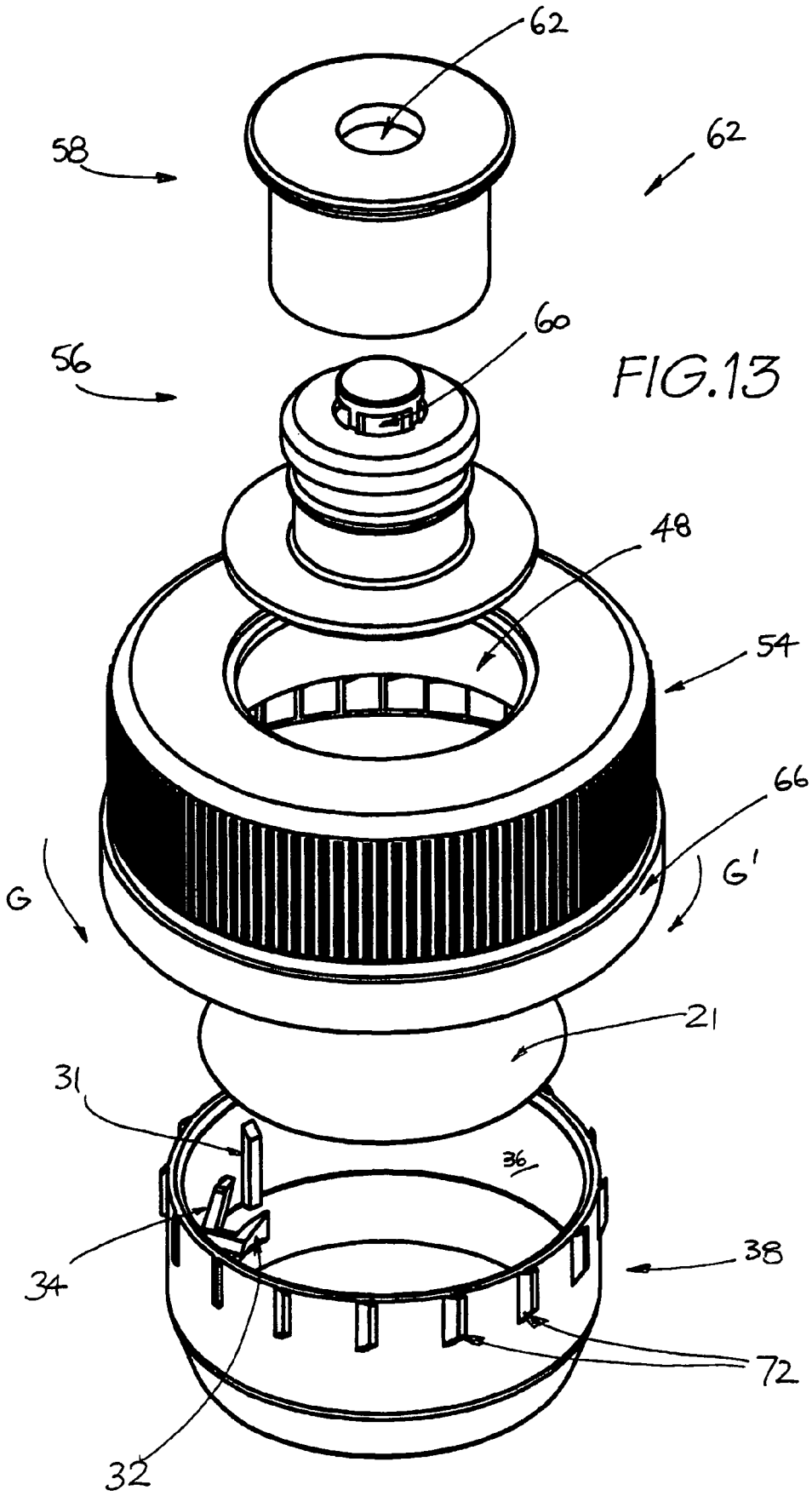
FIG. 13 shows a top perspective, exploded, sectional view of a further embodiment of a lid in accordance with the invention, the lid fitted with an openable seal and a sleeve which is insertable into the opening of a receptacle, the sleeve having a projection in accordance with the invention fitted thereto; the lid also having a second openable access orifice.
Figure 14:
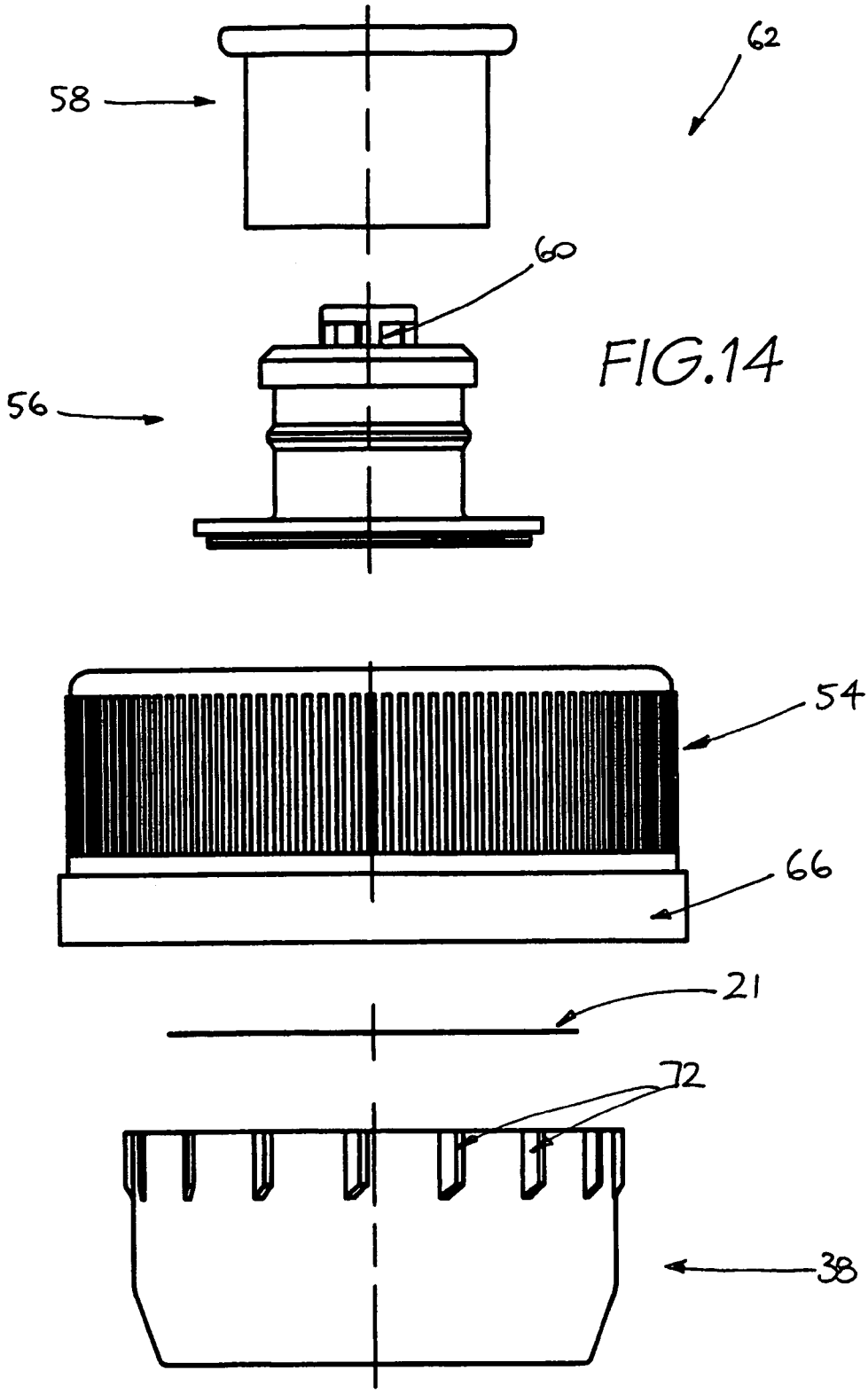
FIG. 14 shows a side elevational view of the embodiment of FIG. 13.
Figure 15B:
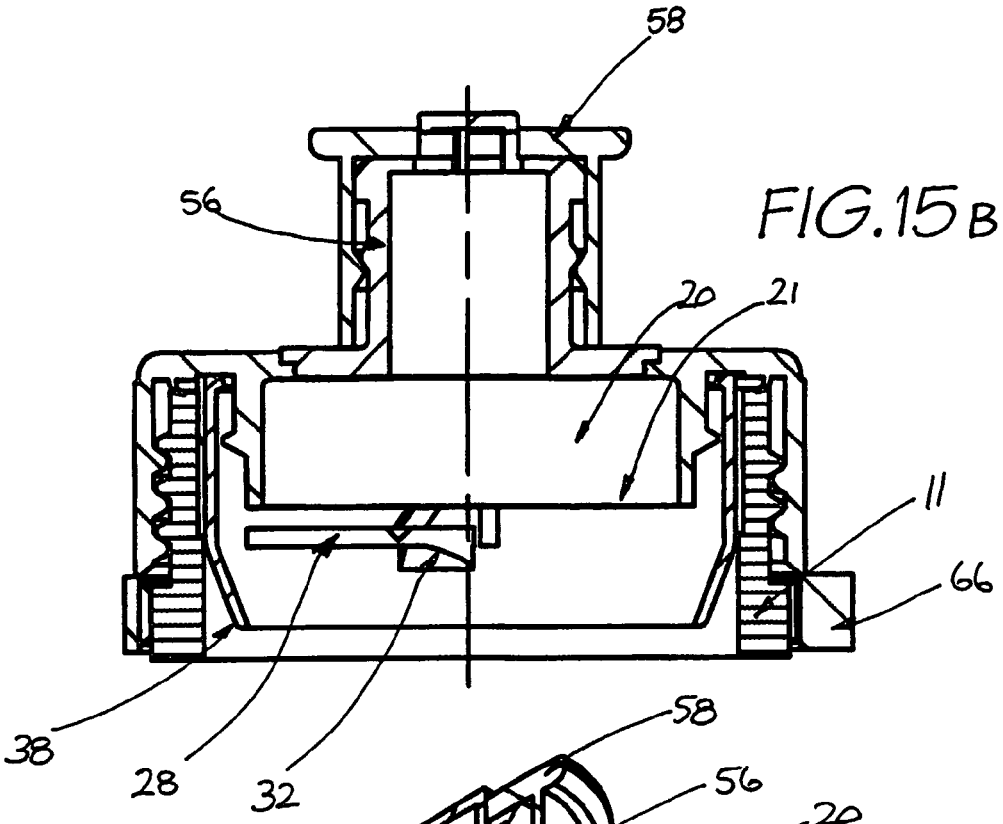
FIGS. 15*a* and 15*b* respectively show a perspective, and a side elevational view, both views being sectioned, of the in use assembly of lid, seal and sleeve of FIGS. 13 and 14 when fitted to a receptacle opening, the projection on the sleeve not yet moved from its initial position into its deployed position to cut the seal.
Figure 15A:
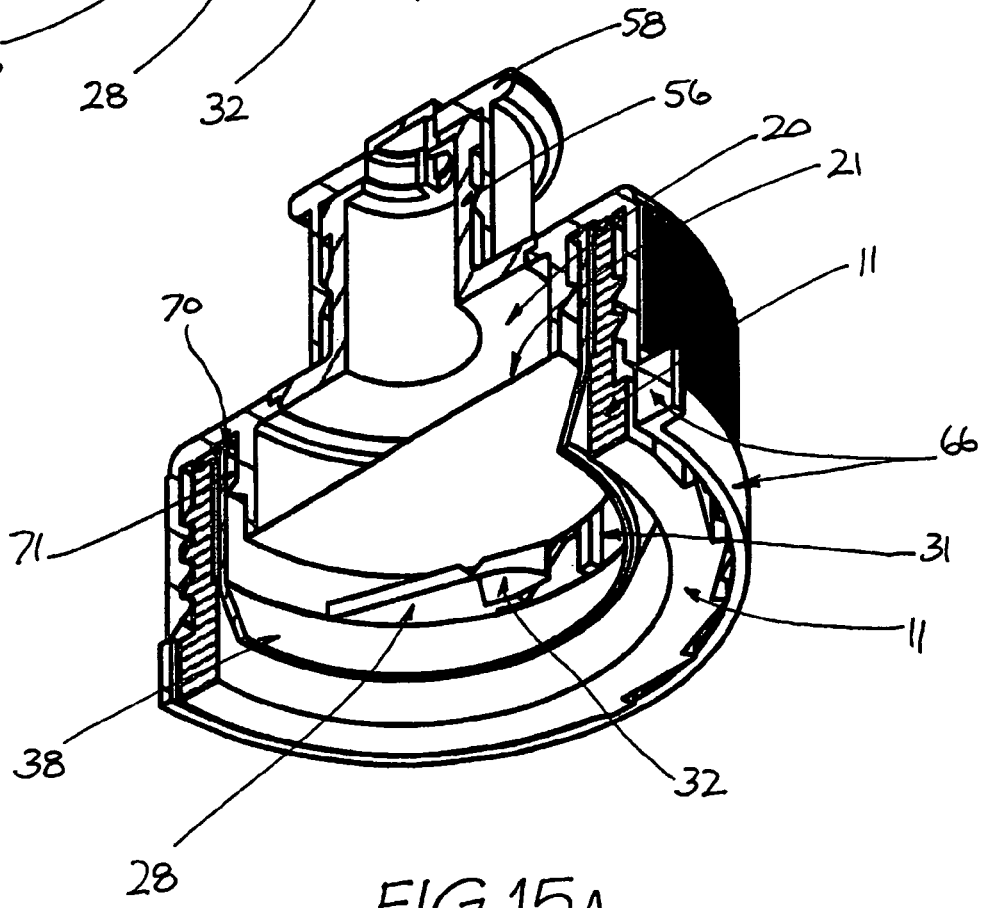

In a further embodiment of the invention 62 as shown in FIGS. 13 to 15, the lid 54 of the device can include the feature of a closeable projecting teat in the form of a drink-through spout 56 similar to that known in water and sports-type drink bottles. Typically the spout 56 is positioned over the orifice 48 in the lid 54 (in the location where the lid disc 44 is located in the embodiment shown in FIG. 10 to 12). The spout 56 also includes a retractable drink-through cap 58 which is fitted over the spout 56 and is slidably moveable from a closed position where the cap 58 is in close contact with the spout 56 (so as to prevent the flow of liquid from the compartment 20 via the discharge hole 60 in the spout 56) to an open position where the cap 58 is moved away from the spout 56 (so as to allow flow of liquid from the compartment 20 via the discharge hole 60 and through the corresponding hole 62 in the cap 58). In use the cap 58 can be pulled upwardly into an 'open' position so that fluid (or fluid-solid mixtures etc.) can be dispensed from the receptacle. Closure of the spout 56 can be effected by depressing the cap 58. Prior to drinking the contents of the receptacle, the rotation of the cap 54 thereon can initiate the movement of the cutter 32 to break the seal on the compartment 20 and to release the substance from the compartment 20, as already described.

In any of the previously described embodiments the lid 12, 50, 54 can be fitted with a tamper-evident seal. Referring to the Figures, the seal is shown in the form of a strip 66 which is formed as a portion of the lid 12, 50, 54 and which is joined to the edge rim 64 of the lid 12, 50, 54 by a line of weakness (e.g. a series of perforations or a thin section of lid material). In use when the lid 12, 50, 54 is fitted to a receptacle in the form of a bottle or container, the strip 66 is in contact with the exterior surface of the receptacle. The innermost circumferential face of the strip 66 has a series of projecting teeth 68 or serrations which initially are in gripping contact with the receptacle. In use, before the lid 12, 50, 54 can be rotated to cut the seal 21 at the edge rim 22 of the compartment 20, the tamper evident strip 66 needs to be physically torn off the rim 64 of the lid 12, 50, 54 so that the teeth 68 no longer grip onto the exterior surface of the receptacle. In further embodiments the tamper-evident strip may be laterally expanded during the rotational movement of the lid and the strip need not be completely torn from the lid. In such an example the relative movement of the lid and the resistance to movement of the strip, because of the grip of the teeth onto the exterior surface of the receptacle, can cause the partial separation of the strip from the lid.

A tamper-evident strip can provide a convenient visual indication to a potential user of the receptacle that the lid 12, 50, 54 has already been at least partially rotated, and, as such, it is likely that the seal 21 at the rim 22 of the compartment 20 has also been perforated or torn by that rotational movement. Thus the quality or integrity of the substance held in the compartment 20 may have been compromised. In an alternative arrangement, the receptacle can be at least partially transparent, so that a user can determine if the seal at the compartment 20 has already been compromised.

FIGS. 16 to 19 show an alternative embodiment of a lid 120 and sleeve 380 for location at an opening throat of a receptacle. In order to avoid repetition and for ease of reference, similar components and features of this alternative embodiment of the invention have been designated with an additional "0", such as the lid 120. The lid 120 has a plurality of engagement means in the form of longitudinal ribs 240 which projects outwardly from the external wall 260 of the compartment 200. When assembled, there is at least a small clearance distance between the interior surface 360 of the sleeve 380 and the longitudinal ribs 240, in order to allow relative movement therebetween. The longitudinal ribs 240 on the compartment 200 external wall 260 are arranged in use to bias the cutter 320 into a position that opens the sealed compartment 200 in a similar manner as already described. The sleeve 380 has a smooth exterior surface which is manufactured to be of a tight frictional fit for receipt within the receptacle opening throat. In this arrangement, the rotational removal of the lid 120 from the receptacle causes compartment opening but does not facilitate detachment of the sleeve 380 from its association with the receptacle, and the sleeve 380 remains in position during pouring or consumption of the contents of the vessel from the opening throat.

The device can be used in many different applications, for example for pharmaceutical and drug dispensing, 'sports' type and vitamin supplement drinks and alcoholic and non-alcohol mixer drinks. The device can also be applied to the introduction of any chemicals into a process liquid, for example a process where a concentrate of some kind is required to be introduced into water or a base carrier, for example colouring and tinting (in hairdressing or graphic arts printing). In a further example, an industrial type application can be in the mixing of resins, glues and epoxy compounds, or other two-part products. The substance being dispensed from the compartment can be a liquid for example an ink or an emulsion, or solid materials such as powders or ground material, tablets, granules, chopped leaves or plant matter etc. The substance can be maintained in a sterile environment once it is sealed in the airtight and watertight compartment. The integrity of many products is enhanced when mixed or combined immediately prior to their use or consumption.

The operation of the device is intuitive, simply requiring the cap to be unscrewed from the receptacle (or in some cases merely turned in relation to the receptacle) in order to effect dispensation of the substance from the compartment. Because of its simplicity, the tooling costs for manufacturing such a device are minimised. In many of the prior art devices, the tooling costs are expensive because the devices have too many components that require assembly, and by their shape and configuration limit the type of substances that can be dispensed.

The device may be of any particular shape, suitable for use in receptacle mouths of different shapes, for example round, oval, square etc. as the situation demands. In further embodiments the compartment can be of any suitable shape that fits into the mouth of the receptacle, for example a circular, square or rectangular cylinder, and made of lightweight plastic, foil metal or other material which can be used to form a stable bladder or chamber that separates a substance from the fluid in the receptacle.

The materials of construction of the lid and the engagement means, the sleeve (if there is one) and the projection, can comprise any suitable materials which can be shaped, formed and fitted in the manner so described, such as metal or hard plastics which can be injection moulded to give a structurally sound device.

The embodiments of the invention shown can provide an improved two part vessel which can keep the contents of a compartment separated from the contents of the main portion of the vessel until mixing is required. By associating the projection with the receptacle (including, for example, a sleeve positioned in the mouth of the receptacle), and by causing the projection itself to be moved, the lid including the compartment can be of simpler construction than those known in the art for this purpose, and, as a consequence, simpler to use. Furthermore, as a result, the method of opening the receptacle is simplified in comparison to the known prior art devices so that the user only needs to undertake one intuitive action of turning the lid of the receptacle to accomplish the two separate functions of opening the compartment in the lid to allow combining of the contents of the compartment and the receptacle, and opening the receptacle itself, immediately prior to use of the combined contents.

It is to be understood that, if any prior art information is referred to herein, such reference does not constitute an admission that the information forms a part of the common general knowledge in the art, in Australia or any other country.

Whilst the invention has been described with reference to a number of preferred embodiments it should be appreciated that the invention can be embodied in many other forms.

The invention claimed is:

1. A dispensing device for location at an opening to an associated receptacle, comprising:

a closure assembly comprising an outer lid, and an inner sleeve positioned within said outer lid, said assembly being configured for mounting at the opening of the associated receptacle, said lid including a compartment, positioned inwardly of said inner sleeve, which is positionable at the opening when the assembly of the outer lid and the inner sleeve is located at the opening and attached to the receptacle, said assembly including an openable seal which initially closes said compartment of said lid, said device including a movable projection arrangement for cutting said openable seal attendant to initial removal of said closure assembly from said receptacle, during which initial removal said outer lid rotates relative to said inner sleeve, said projection arrangement including a support member on an inside surface of said inner sleeve, and a movable cutter hingedly joined to said support member for cutting engagement with said openable seal, said projection arrangement further including an engagement portion, joined integrally with said moveable cutter for hinging, pivotal movement therewith relative to said support member, said engagement portion being positioned between an outside surface of said compartment, and an inside surface of said inner sleeve, said cutter being positioned inwardly of said engagement portion for engagement of said cutter with said openable seal, said engagement portion being engageable with a protrusion on the outside surface of said compartment during initial removal of said closure assembly from said receptacle as said outer lid rotates relative to said inner sleeve, engagement of said engagement portion with said protrusion acting to pivotally move said engagement portion and said cutter in unison, so that said cutter engages and cuts said openable seal and at least partially detaches said openable seal from said compartment, with further rotation of said outer cap relative to said inner sleeve causing said cutter to further engage and cut said openable seal, said assembly of said outer lid and inner sleeve being removable together from said receptacle after contents of said compartment have been dispensed into said receptacle.

2. A device as claimed in claim 1 wherein the protrusion comprises at least one flange located on an external wall of the compartment.

3. A device as claimed in claim 1 wherein the lid is rotatable relative to the receptacle.

4. A device as claimed in claim 3 wherein the lid is attached to the receptacle via rotation in a first direction and is detached via rotation in a second opposite direction.

5. A device as claimed in claim 3 wherein the lid is adapted for threadable engagement with the receptacle.

6. A device as claimed in claim 1 wherein the compartment is also adapted for access from another location other than via the seal.

7. A device as claimed in claim 6 wherein the access adaptation is a closeable orifice in an exterior surface of the lid.

8. A device as claimed in claim 7 wherein a removable or insertable disc is arrangeable for engagement with a rim of the orifice in a closed position.

9. A device as claimed in claim 6 wherein the access adaptation is a closeable projecting teat located at an exterior surface of the lid.

10. A device as claimed in claim 1 wherein the sleeve positionable in a neck of the receptacle and the projection arrangement protrudes inwardly of the sleeve.

11. A device as claimed in claim 10 wherein the sleeve comprises:

a mounting for holding the sleeve in a freely rotatable but axially fixed manner in relation to the lid;

one or more deformable retaining means located externally of the sleeve for holding it in an associative frictional engagement at the opening of the receptacle;

a rib flange located at an internal wall of the sleeve and arranged to abut the engagement means upon rotatable movement of the lid at the receptacle, wherein when the lid is rotated the engagement means abuts the rib flange and further rotation of the lid thus causes the lid and the sleeve to rotate together but only as allowed by the deformation of the retaining means, thereby detaching the sleeve from its association with the receptacle.

12. A device as claimed in claim 11 wherein the mounting comprises a circumferential or part-circumferential retaining rib located on the internal wall of the sleeve which in use is seated in a groove located on an outer surface of the compartment.

13. A device as claimed in claim 1 wherein the lid is provided with a tamper-evident seal.

14. A device as claimed in claim 13 wherein the seal is a strip detachably positioned at an edge rim of the lid which adjoins the receptacle in use.

* * * * *